US012440738B2

(12) United States Patent
Bryson

(10) Patent No.: US 12,440,738 B2
(45) Date of Patent: Oct. 14, 2025

(54) SYSTEM FOR ANALYZING GOLF CLUB SELECTION, SWING CHARACTERISTICS, AND GOLF COURSE PLAYABILITY

(71) Applicant: David Matthew Bryson, Chattanooga, TN (US)

(72) Inventor: David Matthew Bryson, Chattanooga, TN (US)

( * ) Notice: Subject to any disclaimer, the term of this patent is extended or adjusted under 35 U.S.C. 154(b) by 884 days.

(21) Appl. No.: 17/496,884

(22) Filed: Oct. 8, 2021

(65) Prior Publication Data

US 2022/0111275 A1 Apr. 14, 2022

Related U.S. Application Data

(60) Provisional application No. 63/089,870, filed on Oct. 9, 2020.

(51) Int. Cl.
*A63B 60/46* (2015.01)
*A63B 69/36* (2006.01)

(52) U.S. Cl.
CPC ..... *A63B 60/46* (2015.10); *A63B 69/3605* (2020.08); *A63B 69/3632* (2013.01); *A63B 2220/12* (2013.01); *A63B 2220/40* (2013.01); *A63B 2220/833* (2013.01); *A63B 2225/54* (2013.01)

(58) Field of Classification Search
CPC . A63B 60/46; A63B 69/3605; A63B 69/3632; A63B 2225/54; A63B 2220/40; A63B 2220/833; A63B 2220/12
See application file for complete search history.

(56) References Cited

U.S. PATENT DOCUMENTS

| | | | | |
|---|---|---|---|---|
| 7,264,554 | B2 | 9/2007 | Bentley | |
| 8,398,508 | B2 | 3/2013 | Logitti, III et al. | |
| 8,647,214 | B2 | 2/2014 | Wiegers | |
| 10,159,885 | B2 | 12/2018 | Thornton et al. | |
| 10,226,681 | B2 | 3/2019 | Thornton et al. | |
| 2015/0126308 | A1* | 5/2015 | Penn | G06V 40/23 473/407 |
| 2015/0328523 | A1 | 11/2015 | Heling et al. | |
| 2016/0001127 | A1* | 1/2016 | Sato | A61B 5/6895 473/223 |
| 2016/0131167 | A1* | 5/2016 | Taniguchi | G01C 19/00 473/516 |
| 2017/0312609 | A1* | 11/2017 | Thornton | A63B 60/46 |
| 2019/0105547 | A1* | 4/2019 | Wyeth | A63B 69/3623 |
| 2022/0111275 | A1* | 4/2022 | Bryson | A63B 71/0669 |

* cited by examiner

*Primary Examiner* — Raleigh W Chiu
(74) *Attorney, Agent, or Firm* — Royal W. Craig

(57) ABSTRACT

A system for golf analysis with a passive data collection device inserted and affixed inside the interior shaft of each of a set of golf clubs, and an active data receiving device in wireless communication. The data receiving device polls the data collection device for data inclusive of geographic coordinates corresponding to points along a golf course, and golf club selection at said points, analyzes the data relative to prestored golfer and course data, and displays analytic results to the golfer, golf instructor, course administrator or others.

15 Claims, 17 Drawing Sheets

Golf Course Administrator -2600
"Real Time" Screen Shots

2601

Spreadsheet View

2603

| Hole # | Golfers | SPT | CPT | Pace | MV | Up MPH |
|---|---|---|---|---|---|---|
| 1 | 2 | 7 min | 5.5 min | minus 1.5 | no | no |
| 2 | 4 | 9 min | 8.75 min | minus .25 | no | no |
| 3 | 4 | 5 min | 7 min | plus 2 | yes | 1 mph |
| 4 | 3 | 5.5 min | 5.75 min | plus .25 | no | no |
| 5 | 2 | 7.25 min | 8.5 min | plus 1.25 | yes | 1 mph |
| 6 | 4 | 8.25 min | 10.25 min | plus 2 | no | no |
| 7 | 4 | 7.05 min | 8 min | plus .95 | no | no |
| 8 | 2 | 5.75 min | 5.5 min | minus .25 | no | no |
| 9 | 3 | 8.5 min | 12 min | plus 3.5 | yes | 1 mph |
| 10 | 4 | 7.25 min | 10 min | plus 2.75 | yes | 1 mph |
| 11 | 0 | n/a | n/a | n/a | n/a | n/a |
| 12 | 2 | 7.75 min | 8.5 min | plus .75 | no | no |
| 13 | 3 | 5.5 min | 6.25 min | plus .75 | no | no |
| 14 | 1 | 11 min | 12 min | plus 1 | no | no |
| 15 | 4 | 8.25 min | 12 min | plus 3.75 | yes | yes |
| 16 | 3 | 6.75 min | 7.25 min | plus 1 | no | no |
| 17 | 4 | 9.75 min | 11 min | plus 1.25 | no | no |
| 18 | 2 | 7 min | 7.5 min | plus .5 | no | no |

Code:
SPT- Standard Play Time
CPT- Current Play Time
MV- Marshal Visit

2602

Hover View

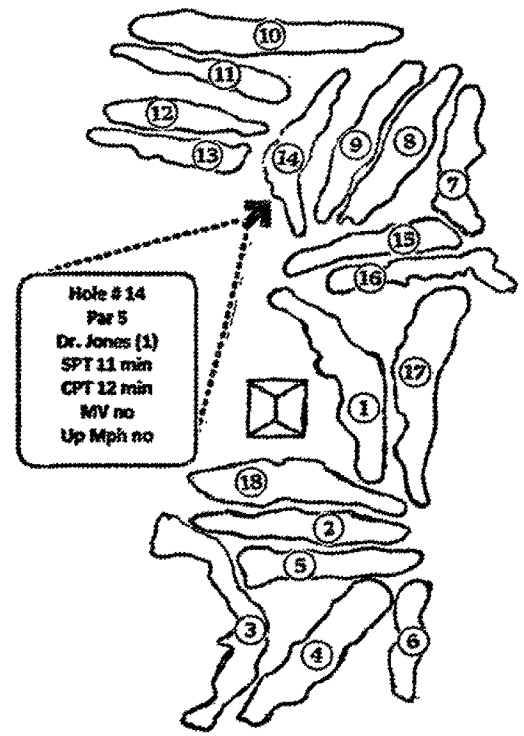

FIG. 13

Instructional Screen Shots –2900

2901

Spreadsheet View

2903 – 7 IRON HISTORY JAN. 1, 2021-FEB 28, 2021

2904 –

| COURSE | DATE | HOLE | PAR | SHOT | B LOC | DTP | SD | ACCL. | SPIN | CFOI | IR |
|---|---|---|---|---|---|---|---|---|---|---|---|
| Wil Bay | 1/7 | 2 | 4 | 2 | ROF | 87 | 84 | 65 | 7000 | 1 C | 7 |
| Wil Bay | 1/7 | 5 | 3 | 2 | FR | 82 | 78 | 67 | 7100 | L | 7 |
| Wil Bay | 1/7 | 7 | 4 | 3 | FR | 77 | 82 | 70 | 6950 | 1.2 C | 8 |
| Wil Bay | 1/7 | 9 | 5 | 4 | ROF | 79 | 84 | 64 | 6977 | .8 O | 5 |
| Wil Bay | 1/7 | 14 | 5 | 4 | LOF | 81 | 80 | 71 | 6981 | 2 C | 9 |
| Wil Bay | 1/7 | 18 | 4 | 3 | RF | 69 | 72 | 68 | 7007 | 1.8 O | 8 |
| Oaks | 2/14 | 1 | 4 | 3 | RF | 71 | 65 | 69 | 7010 | L | 7 |
| Oaks | 2/14 | 4 | 3 | 1 | T | 74 | 70 | 65 | 6988 | L | 5 |
| Oaks | 2/14 | 7 | 5 | 5 | ROF | 88 | 79 | 66 | 71 | .1 C | 5 |
| Oaks | 2/14 | 8 | 4 | 4 | LOF | 77 | 73 | 69 | 6850 | 1.5 O | 7 |
| Oaks | 2/14 | 15 | 5 | 4 | LF | 79 | 71 | 72 | 7002 | 1 C | 8 |
| Oaks | 2/14 | 17 | 4 | 3 | ROF | 68 | 75 | 73 | 7020 | 1 C | 9 |
| Spn Moss | 2/28 | 4 | 3 | 2 | RF | 72 | 77 | 68 | 6900 | L | 9 |
| Spn Moss | 2/28 | 9 | 4 | 5 | RF | 77 | 69 | 64 | 6890 | 2 O | 5 |
| Spn Moss | 2/28 | 12 | 4 | 4 | ROF | 79 | 74 | 67 | 6902 | 1.4 C | 6 |
| Spn Moss | 2/28 | 15 | 5 | 4 | LF | 81 | 71 | 69 | 7002 | L | 8 |

Code:

B Loc- Ball location
ROF-Right of Fairway
FR- Fairway Right
LOF- Left of Fairway
FL- Fairway Left
T- Tee Box
IR- Impact Rating

DTP- Distance to Pin
SD- Shot Distance
Accl.- Acceleration in Mph
Spin- in revolutions per minute
CFOI- Club face on impact (in degrees)
CFOI terms C,O, L- Closed, Open, Level

2902

Hyperlink Film View

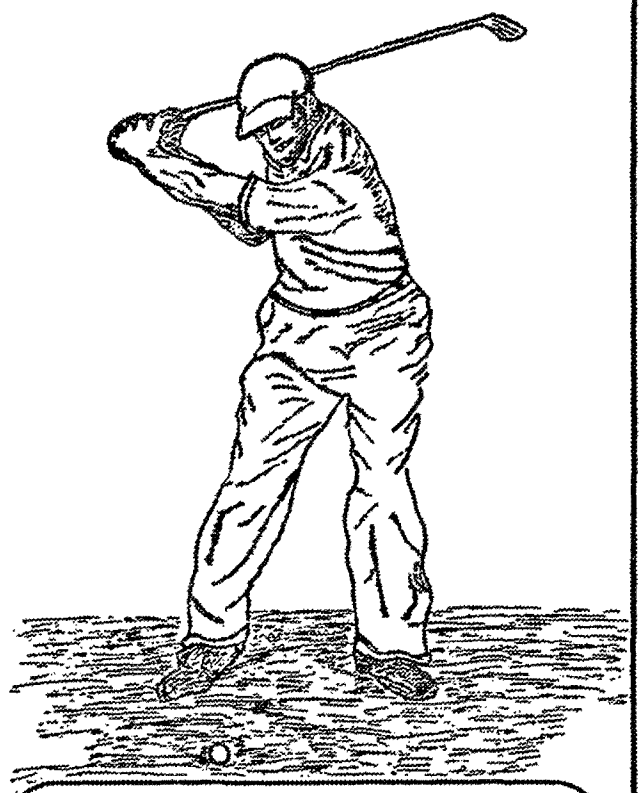

Willow Bay CC, Jan. 7, 2021, 7 Iron
Hole 2, Par 4, Shot 2, ROF, DTP 87, SD 84
Accl. 65 mph, Spin 7000 rpm, CF Closed 1 degree, Impact Rating 7

FIG. 14

"Course Playability" Screen Shots – 1402

3201

Spreadsheet View

3203

| Hole # | #1 | #2 | #3 | #4 | #5 | #6 | #7 | #8 | #9 |
|---|---|---|---|---|---|---|---|---|---|
| White Tee | 5% | 7% | 7% | 5% | 7% | 5% | 5% | 5% | 5% |
| Yellow Tee | 85% | 82% | 82% | 85% | 87% | 85% | 80% | 85% | 85% |
| Red Tee | 10% | 11% | 11% | 10% | 11% | 10% | 15% | 10% | 10% |
| 1st Sand | 1% | 2% | 4% | 5% | 3% | 7% | 1% | 3% | 1% |
| 2nd Sand | 5% | 2% | 1% | 7% | 1% | 1% | 3% | 5% | 7% |
| 3rd Sand | n/a | n/a | n/a | 1% | n/a | 4% | n/a | 4% | 9% |
| 4th Sand | n/a | n/a | n/a | n/a | n/a | 9% | n/a | n/a | n/a |
| 1st H2O Haz | 4% | n/a | n/a | 1% | 25% | 17% | n/a | n/a | 12% |
| 2nd H2O Haz | n/a | n/a | n/a | n/a | 21% | 9% | n/a | n/a | n/a |
| OB Right | 12% | 4% | 3% | 7% | 11% | 22% | 8% | 2% | 4% |
| OB Left | 3% | 5% | 9% | 5% | 5% | 3% | 10% | 17% | 7% |
| OB Beyond | 1% | 3% | 7% | 1% | 2% | 9% | 12% | 11% | 2% |
| 1st Shot Avg | 175 | 200 | 155 | 190 | 137 | 188 | 171 | 158 | 177 |
| 2nd Shot Avg | 120 | 110 | 99 | 120 | 47 | 83 | 127 | 97 | 152 |
| 3rd Shot Avg | 42 | 57 | 61 | 77 | 21 | 51 | 91 | 54 | 87 |
| Putts Avg | 2 | 3 | 2 | 3 | 2 | 2 | 4 | 2 | 2 |
| Avg Hole Score | 5 | 7 | 4 | 7 | 5 | 4 | 6 | 4 | 5 |
| Hole Rating | 7 | 8 | 5 | 9 | 7 | 2 | 5 | 7 | 3 |

Code:
H2O- Water
OB- Out of Bounds
Haz- Hazard
Avg- Average

3202

Hover View

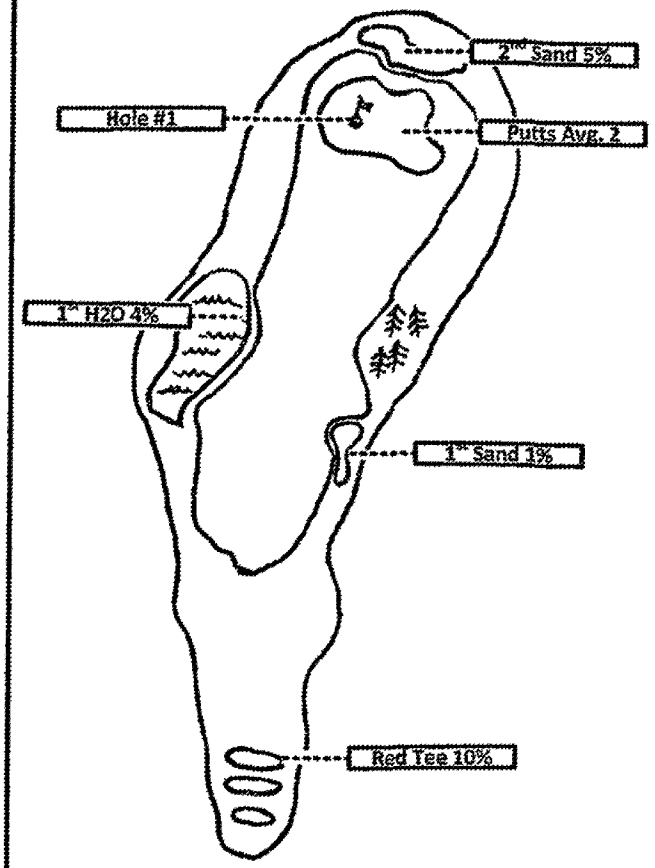

FIG. 16

SYSTEM FOR ANALYZING GOLF CLUB SELECTION, SWING CHARACTERISTICS, AND GOLF COURSE PLAYABILITY

CROSS-REFERENCE

The present application derives priority from U.S. Provisional Patent Application 63/089,870 filed on Oct. 9, 2020.

BACKGROUND a. Field of Invention

The invention relates to the sport of golf, and more particularly to data collection, data interpretation, and data analysis to provide a more robust, accurate and scientific understanding of the physics governing said sport as data relates to the athlete's mechanics and performance, as well as, to the playability and flow of a golf course.

b. Background of the Invention

In the art of sport, more particularly golf, certain universal principles of physics govern the flight path of a golf ball upon impact with the club face of a golf driver, iron, or putter. These universal principles are non-negotiable and are consistent independent of golfer, golf course, and/or golf equipment.

Therefore, if one is able to isolate the data of a particular golf swing and interpret the physics contributing to the golf ball flight path then it stands to reason that improvement can be made in play for the individual golfer through a refinement of skills based on said data and the interpretation thereof.

Additionally, said captured data translates into other fields within the golf industry such as but not limited to; the field of competitive golf, golf course and country club management, golf iron and equipment manufacturers, golf apparel and merchandise manufacturers and retailers, as well as the general advertising industry.

As pertaining to aforementioned universal principles of physics, numerous methods for isolating and identifying these principles as uniquely exerted by the individual golfer have been attempted. The result being a sport, golf, that is littered with gadgets that address, or attempt to address, certain aspects of a golf swing fairly well but neglect other contributing factors in the successful execution of a scientifically "true" swing. The problem of gadget practicality often becomes a limiting factor. For example, devices exist with multiple sensors and multiple sensor attachment points on the person of a golfer. While such a device may generate accurate and informative data in a controlled and closed environment setting it possesses little interpretive value for the golfer in a "live" round setting on the basis of being impractical and cumbersome.

Furthermore, the sport of golf though littered with a myriad of gadgets spanning the spectrum from full-body contraptions to isolated and one dimensional devices, or one trick ponies if you will, lacks a comprehensive device, approach, and system that encompasses multiple sectors of the golf industry simultaneously and in a non-cumbersome and manageable manner.

Therefore, what is clearly needed is a device and method for golfer swing analysis that solves the problems mentioned above.

SUMMARY OF THE INVENTION

An invention which comprises hardware, software, firmware or a combination thereof.

Hardware:

The hardware to be an enclosure containing an integrated circuit, with power source (battery), inserted and affixed to the interior shaft of a golf driver, iron, and/or putter.

The enclosure to be made of light-weight material, possessing a water-proofing element, and a footprint no wider than the internal diameter and no longer than the internal length of a golf shaft.

The integrated circuit to contain, a multi-element sensing system to comprise of a driver/iron/putter identifying component, an inertial type sensor (one or more accelerometers, gyroscopes, magnetometers), a location determining aspect (GPS, GLONASS, Galileo, BeiDou system, pedometer, magnetometer, or other dead-reckoning component), a communication component, a power source (battery), and/or to comprise other types of sensors and methods to be used to sense club selection, swing characteristics and/or course playability.

The hardware to be inserted into golf driver, iron, and/or putter shaft with golf grip applied to golf shaft in standard fashion.

Software:

The software to be utilized in the form of downloadable technology such as an App.

App to be accessed through technology such as a smart watch, smart phone, personal computer, and/or other computing device(s).

A "User Profile" to be created per individual golfer.

User Profile to comprise information such as gender, year of birth, height, weight, left/right handed, manufacturer of golf irons and model of iron used by user, and any additional information deemed relevant in advancing an understanding unique to the individual golfer.

The User Profile existing in order to sync collected swing and play data of a particular user associated with a particular golf driver, iron, and/or putter.

Software will recognize location through location determining component capabilities mentioned above, software can utilize other methods, to potentially comprise of pedometer, compass, and/or other dead-reckoning location technology.

Upon recognition of location said software can populate stored cartography data of particular location, this can comprise of information such as elevation, course layout, and/or course characteristics such as sand bunkers, water hazards, etc.

An accelerometer(s) will transmit when a particular golf driver, iron, and/or putter has been removed from golf bag and is in hand/use.

As part of driver/iron/putter identifying component an RFID tag, or similar technology, unique to each internal shaft device can transmit to App, upon activation by inertial sensor component, which driver, iron, and/or putter is in use.

Accelerometers positioned internally on integrated circuit at each end of golf shaft can transmit data unique to each swing, such as club head speed and hand speed.

Gyroscopes positioned internally on integrated circuit at each end of golf shaft can transmit data unique to each swing, such as angular characteristics of golf driver, iron, and/or putter head and shaft orientation at address, back swing, forward swing and follow through.

Power source to comprise of a battery, either disposable or rechargeable.

This summary is provided to introduce a selection of concepts and general configurations in a simplified form that are further expounded upon in the detailed description below. This summary is not intended to identify key features or essential features of the claimed subject matter. Other aspects and advantages of the present invention will be apparent from the following detailed description of the embodiments and the accompanying drawing figures. Pronouns should be interpreted in all cases to include both genders. The use of names and locations is purely fictitious and for illustrative purposes and should not be associated with any real persons or places.

BRIEF DESCRIPTION OF THE DRAWINGS

Additional aspects of the present invention will become evident upon reviewing the embodiments described in the specification and the claims taken in conjunction with the accompanying figures, wherein like numerals designate like elements, and wherein:

FIG. 13 are exemplary screen displays illustrating a spreadsheet view 2601 and a hover view 2602;

FIG. 14 are exemplary screen displays illustrating golfer swing data (left) and a "hyperlink view" (right) that can be isolated, analyzed, and evaluated as a result of golfer swing data capture via device 10 and processed/applied by data receiving device 40;

FIG. 16 is exemplary of screen display(s) of golfer swing data (left) and a hover view (right) with course playability metrics.

Figure 1:
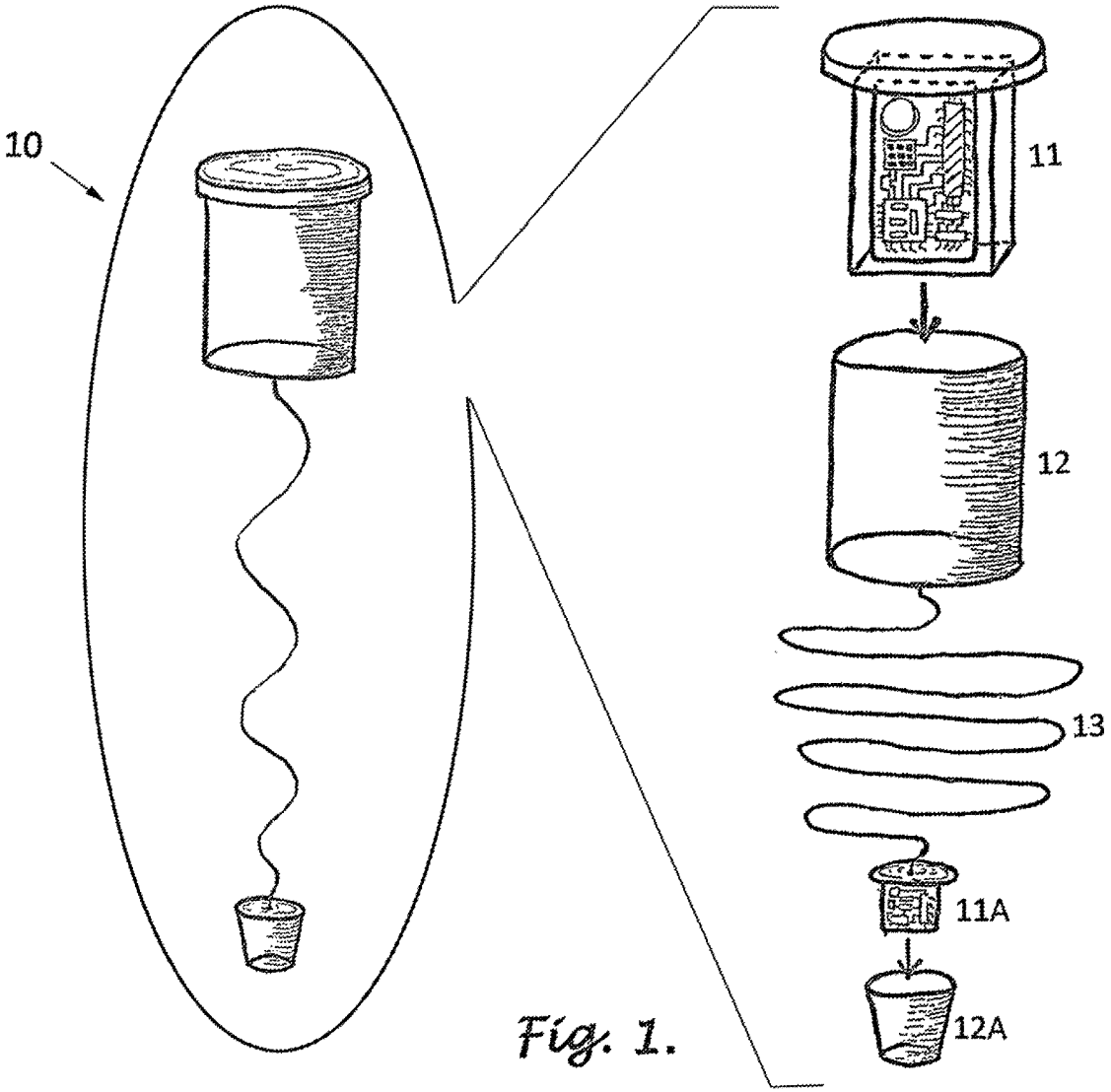
FIG. 1 is an isometric view of an integrated circuit which captures and transmits golf swing data and a housing which can be used as an exemplary embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENT

The following detailed description of the invention references the accompanying drawing figures that illustrate specific embodiments in which the present invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense.

Additionally, in this detailed description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein. Embodiments of the present invention can be implemented in hardware, software, firmware, or a combination thereof.

Figure 2:
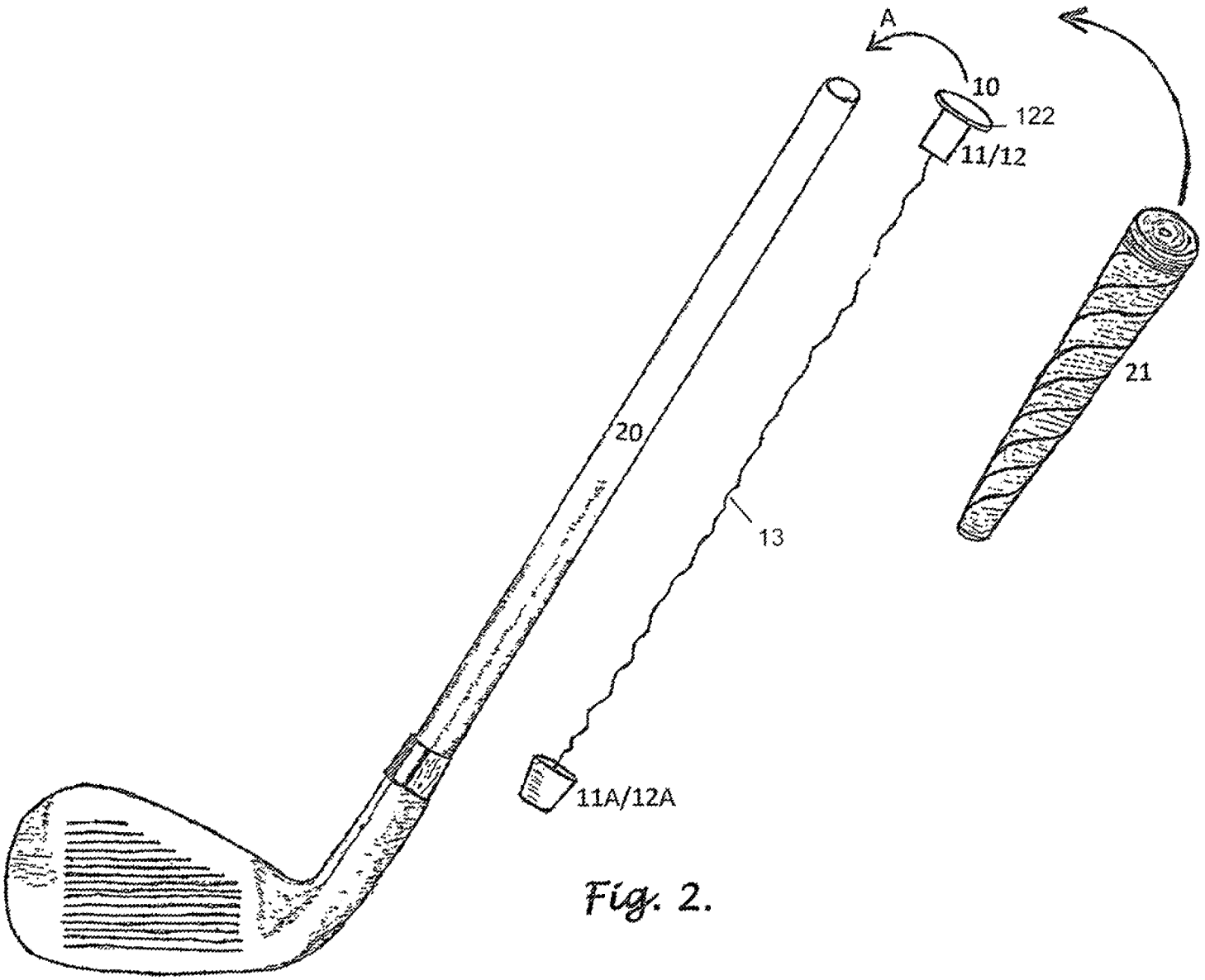
FIG. 2 is an isometric view of the physical application of exemplary embodiment FIG. 1 to the internal aspect of a golf shaft.

In one embodiment, the invention is implemented with an electronic device 10, an example of which is illustrated in FIGS. 1-2. The electronic device 10 comprises a modular two-part integrated circuit 11 and 11A, as well as a modular two-part housing 12 and 12A, and electrical connecting wire 13. The housing 12 and 12A may be made of any durable light weight material such as plastic, and is most preferably water-proof. Electrical wiring 13 connects integrated circuits 11 and 11A and supplies power to integrated circuit 11A if the power source 34 (to be described) is physically located on the integrated circuit 11, or vice versa. A conventional golf club shaft is a long hollow tube, the bottom section tapering in diameter and the top section corresponding to the grip being substantially cylindrical with a constant internal diameter d1. The housing 12/21A has a maximum width slightly less than the diameter d1 of the cylindrical top section of the golf shaft for axial insertion therein and securement therein.

Figure 3:
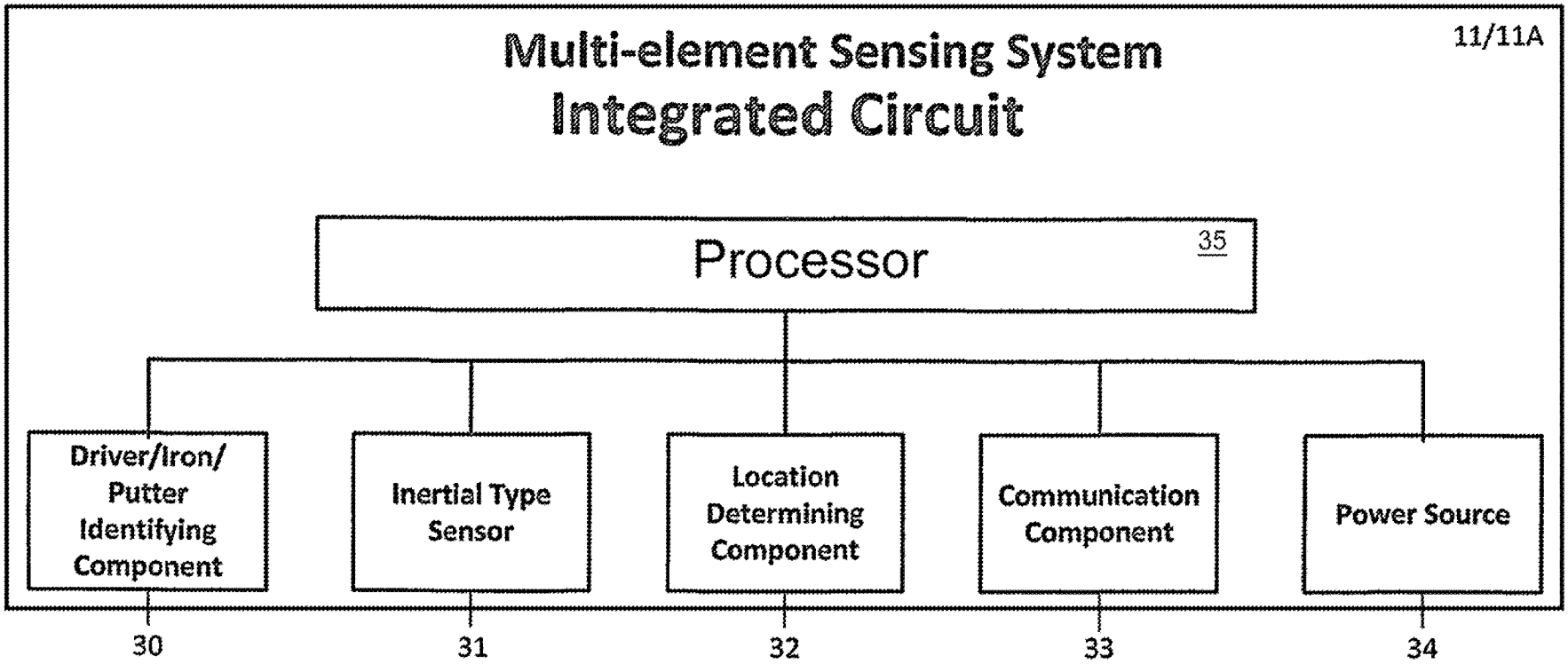
FIG. 3 is a block diagram illustrating certain components of the device of FIG. 1.

The integrated circuit 11/11A comprises a multi-element sensing system as shown in FIG. 3. The multi-element sensing system may include a driver/iron/putter identifying component (RFID tag or other technology) 30, an inertial sensor 31, a location determining component 32 (GPS, GLONASS, Galileo, BeiDou system, pedometer, magnetometer, or other dead-reckoning component), a communication component 33, and a power source 34. One skilled in the art will understand that both integrated circuits 11 and 11A enclosed in housings 12 and 12A may be combined in a single module with integrated circuit 11 inserted in housing 12.

Upper housing 12 is formed as a cylindrical enclosure sized to fit inside the distal upper handle end of the shaft 20 and preferably having a protruding flange 122 to limit insertion and seal the shaft 20. Lower housing 12A is formed as a frusto-conical enclosure sized to fit inside the distal lower head end of the shaft 20.

Referring back to FIG. 2, the device 10 is inserted into the interior space of a golf shaft 20 with upper module 11/12 proximate the distal end of the shaft handle, module 11A/12A proximate the head of shaft 20, and connecting wire 13 running there between. The device 10 may be affixed to the interior of the golf shaft 20 by an adhesive substance such as tape, glue, and/or other securing agent. The device 10 can also work in conjunction with a synthetic insert or ring such as a rubber gasket to secure against internal golf shaft 20 movement by device 10. After device 10 is securely inserted into the interior of the golf shaft 20 a traditional golf grip 21 is applied to golf shaft 20 exterior in standard golf industry application practices.

Referring back to FIG. 3, the club identifying component 30 is preferably an RFD tag or similar identifying technology that has been specifically coded with driver/iron/putter identifying data. For example, club identifying component 30 as inserted into the interior of a golf shaft 20 is coded with information specific to that particular shaft and club head such as which of a driver/iron/putter encapsulates the device 10. If the driver/iron/putter in hand is the "7 Iron" then the club identifying component 30 will communicate such information as "7 Iron" to a remote processor 49 (to be described with reference to FIG. 4). In so identifying the driver/iron/putter selected and in use the software can chronical and store data associated with and generated by the selected driver/iron/putter.

The inertial type sensor(s) 31 may include any or a combination of accelerometer(s), gyroscope(s), magnetometer(s) and/or other similar orientation and/or motion sensing technology. One example of an embodiment of device 10 includes an accelerometer that determines a driver/iron/putter vertical orientation. This function and determination is a starting point for capturing the sequence of golfer swing data. The orientation of a driver/iron/putter in a golf bag, when the bag is in a standard upright position, is that of the golf grip end being in the down position and the club head end being in the up position and extending from the top of a golf bag. In order for the driver/iron/putter identifying component 30 to register a particular driver/iron/putter as in use the driver/iron/putter identifying component 30 must be activated. An exemplary way of activating the driver/iron/putter identifying component 30 is for an accelerometer(s) to determine the vertical orientation of a golf shaft, much like a smart phone screen knows and changes screen view orientation upon vertical/horizontal positioning change. If a driver/iron/putter is removed from the golf bag its orientation changes. An accelerometer(s) tasked with orientation communicates by communication component 33 such orientation change to the data receiving device 40, the data receiving device communicates by communication component 46 to the integrated circuit(s) 11 and/or 11A which in turn activates the dormant driver/iron/putter identifying component 30, thus advancing the sequence/stages of golfer swing data capture.

Figure 4:
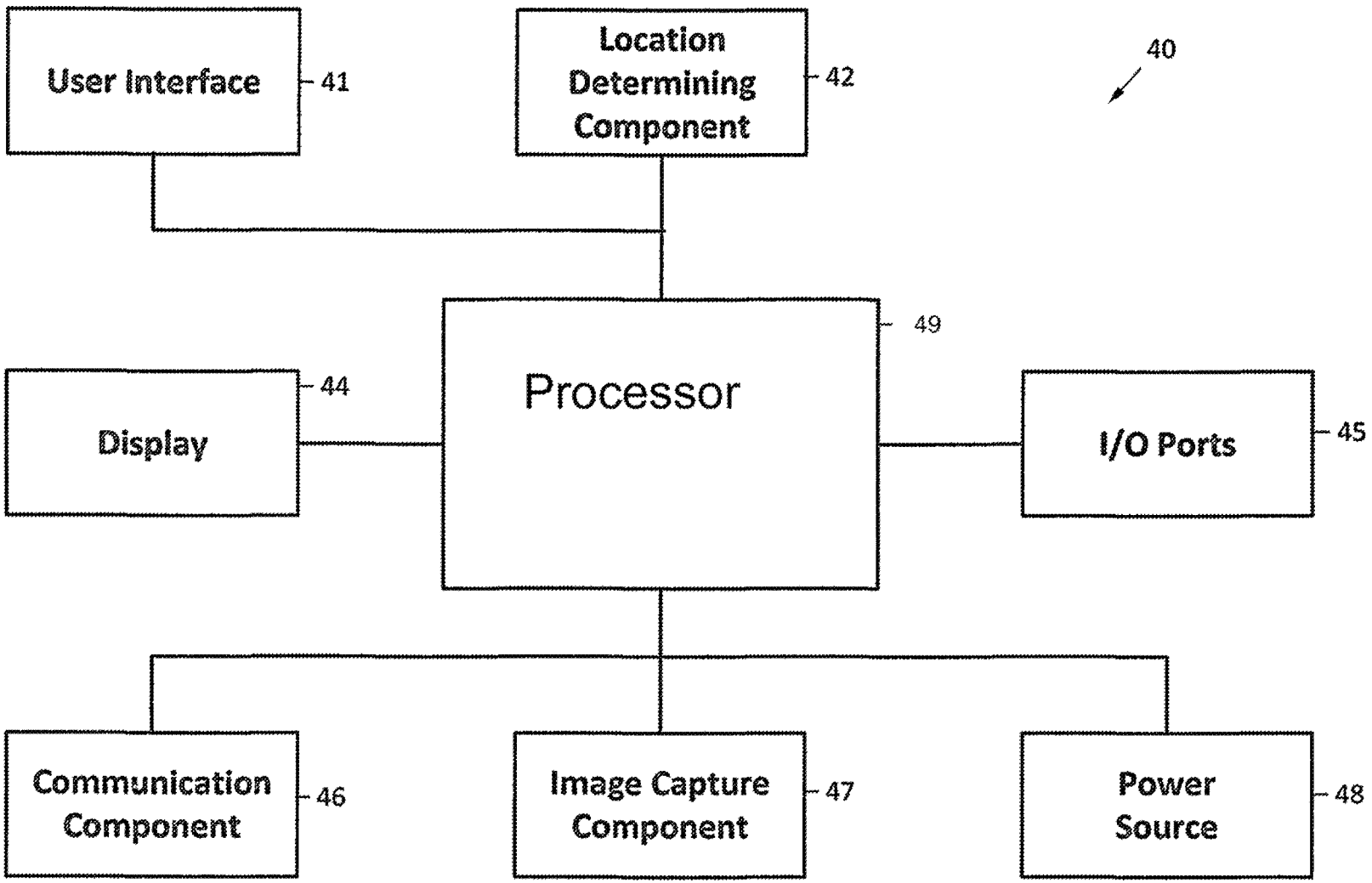
FIG. 4 is a block diagram illustrating certain components of the data receiving device(s) that receive data from the device of FIG. 1.

In another embodiment of the device 10, the use of inertial sensors 31 registers the acceleration, velocity, scope and arc of a golf swing and communicates via communication component 33 such data to a data receiving device 40 (see FIG. 4).

FIGS. 13 & 14 include exemplary "spreadsheet views" of such golfer swing data capture by such inertial sensor(s) capabilities in the columns of "ACCL" (acceleration), "Spin" (spin of golf ball in flight in revolutions per minute), and CFOI (the angular orientation of the Club Face On Impact with the golf ball). This being an example of golf swing data capture application as a result of inertial sensor component 31 but not limited in scope. From such data a statistical history of each driver/iron/putter can be constructed, analyzed, and archived for future reference, as also shown row-by-row in FIGS. 13 & 14.

As seen in FIG. 4, data receiving device 40 is a remote computer likewise having a location determining component 42, display 44, communication component 46, image capture component 47, power source 48, input/output (I/O) ports 45, processor 49, and user interface 41. Data receiving device may, for example, be a conventional smart phone, tablet or the like. The location determining component 42 generates and sends corresponding location data to the processor 49 present in the data receiving device 40 of FIG. 4. In some embodiments, the location determining components 32 and/or 42 of the club device 10 and/or data receiving device 40, respectively, mark an approximate start position of a golf ball, the inertial type sensor(s) 31 recognize and transmit data indicating a golf swing, the golfer travels to the new location of the landed golf ball, and the location determining component 32 and/or 42 register the location of the new position and ball flight distance is therefore calculated.

The location determining component 32 and/or 42 can be a satellite navigation receiver that works with a global navigation satellite system (GNSS) such as the global positioning system (GPS) commonly used in the United States, the GLONASS system primarily used in the Soviet Union, the Galileo system commonly used in Europe, or the BeiDou system primarily used in China.

Figure 5:
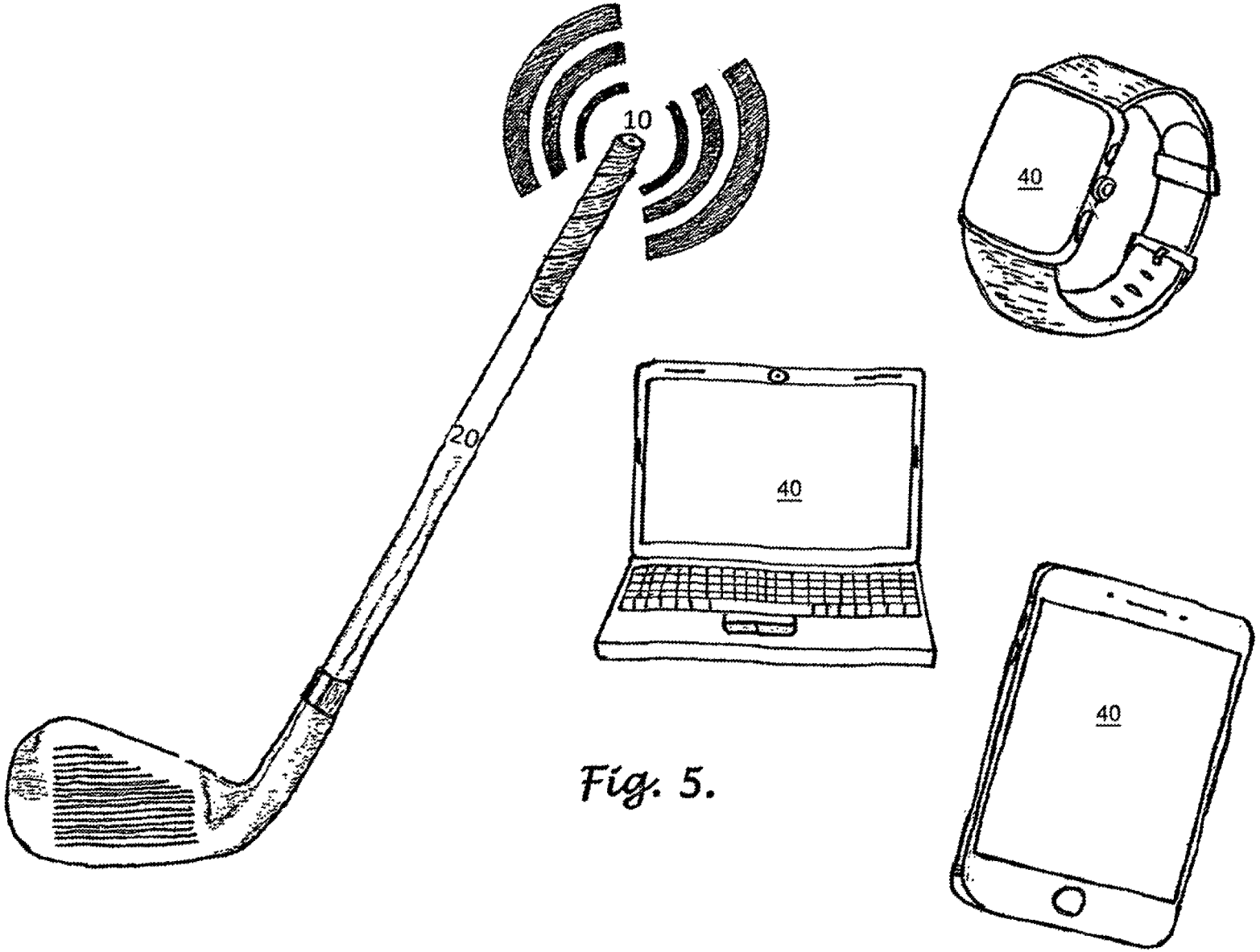
FIG. 5 is an isometric view of the device of FIG. 1 transmitting captured data to exemplary embodiments of data receiving device(s) 40 of FIG. 4.

FIG. 5 illustrates device 10 communicating with various exemplary embodiments of data receiving device(s) 40. In this example, device 10 is transmitting captured data associated with a golf swing to exemplary data receiving device(s) 40 (smart watch, personal computer, and/or smart phone). The location determining components 32 and/or 42 of club device 10 and/or the data receiving device 40, respectively, acquires spread spectrum satellite signals from at least three satellites to calculate its two-dimensional position by triangulation. Acquisition of an additional signal, resulting in signals from a total of four satellites, permits the club device 10 and/or the data receiving device 40 to calculate its three-dimensional position.

The location determining component 32 and/or 42 of club device 10 and/or the data receiving device 40 are operable to receive position data and transmit it to processor 49, which calculates both absolute and relative positions of club device 10 and/or the data receiving device 40 as a function of the signals. The location determining component 32 and/or 42 and processor 49 can also determine track logs or any other series of geographic coordinates corresponding to points along a golf course or other path traveled by a user of the device. The location determining component 32 and/or 42 and/or the processor 49 can also be operable to calculate routes to desired locations, provide instructions to navigate to the desired locations, display maps and other information on the display screen 44, and to execute other functions described herein.

The processors 35, 49 include one or more processors, controllers, or other computing devices and memory so that it can calculate location and other geographic information The location determining component 32 and/or 42 can include an antenna to assist in receiving the satellite signals. The antenna can be a patch antenna, a linear antenna, or any other type of antenna that can be used with navigational devices. The antenna can be mounted directly on or in the housing 12 or 12A, as a function of the integrated circuit 11 or 11A, or can be mounted external to the device 10 or data receiving device 40.

Although embodiments of the location determining components 32 and/or 42 include a satellite navigation receiver, it will be appreciated that other location-determining technology can be used. For example, the communication component 33 and/or 46 may determine the location of the device 10 and/or the data receiving device 40 by triangulation of the signal delay, signal strength, or both. For example, cellular towers or any customized transmitting radio frequency towers can be used instead of satellites. With such a configuration, any standard geometric triangulation algorithm can be used to determine the location of the device 10 and/or the data receiving device 40. In addition, the location of the device 10 and/or the data receiving device 40 may be determined by an outside source, such as a wireless service provider, and transmitted to the location of the device 10 and/or the data receiving device 40 via communication components 33, 46.

The club device 10 and/or the data receiving device 40 can also combine information from inertial sensor(s) 31 or other dead-reckoning components to determine the device's location, and hence the position or location of a golf ball when the location determining component 32 and/or 42 cannot receive satellite or other signals.

The communication component 33 and 46 enables the club device 10 and the data receiving device 40 to communicate with other electronic devices through a communication network, such as the Internet, a local network, a wide area network, an ad hoc or peer to peer network, or a direct connection such as USB, Firewire, or Bluetooth connection or other direct connection avenues. The communication component 33 and 46 may communicate utilizing data transfer methods such as WiFi, Wi-max, Bluetooth, ANT, Ultra-wideband, infrared, cellular telephony, radio frequency and/or other data transfer methods.

The communication component 46 of FIG. 4 data receiving device 40 is transmitting and receiving analyses of captured data from club device 10 to the golfer through display 44, which may be mounted on a golf cart, stand or pull-cart.

The power source 34 and/or 48 provides electrical power to the driver/iron/putter identifying component 30, the inertial type sensor(s) 31, the location determining component 32 and/or 42, the communication component 33 and/or 46, the user interface 41, the processor 49, the display 44, the I/O ports 45, and the image capture component 47 to the integrated circuit(s) 11 and/or 11A of club device 10 and/or the data receiving device(s) 40 of FIG. 4. The power sources 34 and 48 may comprise conventional power supply elements, such as batteries, battery packs, etc. The power sources 34 and 48 may also comprise power conduits, connectors, and receptacles operable to receive batteries, battery connectors, or power cables. The power sources 34 and 48 may also consist of solar power sourced energy, either fully powered by the solar source or in a hybrid conventional power/solar power manner.

The user interface 41 enables a user to operate the data receiving device(s) 40. The user interface 41 can comprise one or more functionable inputs such as buttons, switches, scroll wheels, a touch screen associated with the display 44, voice recognition elements such as a microphone, pointing devices such as mice, touchpads, trackballs, styluses, and/or combinations thereof. The user interface 41 can also include a speaker for providing audible instructions and/or feedback.

As illustrated in FIG. 5 the data receiving device 40 may be a conventional smart watch, computer, smart phone or the like.

The processor 49 can include any number of processors, controllers, integrated circuits, programmable logic device, artificial intelligence attributes, or other computing devices and resident or external memory for storing data and other information accessed and/or generated by the device 10. The processor 49 is preferably coupled with all components associated with data receiving device 40 of FIGS. 4-5.

The display 44 is coupled with the processor 49 and is operable to display various information corresponding to the device 10. Examples of associated information and data received by the data receiving device 40 from data capturing device 10 and displayed can include but is not limited to driver/iron/putter data, swing data such as but not limited to swing acceleration, swing arc, club head face orientation, etc., cartographic data, course and/or hole specific data, weather data, and/or other data and information deemed relevant to the scope of the invention.

The display 44 can be integrated with the user interface 41, such as in embodiments where the display 44 is a touchscreen display to enable the user to interact with data features and/or information associated with and generated by the device 10 via touching, pointing, and/or using a stylus to prompt data and features on the display screen.

The I/O ports 45 permit data and other information to be transferred to and from the processor 49. The I/O ports 45 can include a Secure Digital (SD) card slot, Mini SD Card slot, Micro SD Cards, or the like, and a USB port for coupling with a USB cable connected to another computing device such as a personal computer.

The image capture component 47 is coupled and/or integrated with the data receiving device(s) 40. The image capture component 47 can be a camera(s) with capabilities to include but not limited to still frame image capture and/or live action video. The image capture component 47 can be in a fixed and stationary mount and/or can be equipped with a motion inducing mechanism to enable camera movement to accommodate for better capture angle of image(s) being captured. In use, the image capture component 47 and associated software captures elements of a golfer's swing including but not limited to the full golf swing beginning with address of the golf ball by the golfer and concluding with follow-through motion of the golfer post golf ball impact.

The image capture component 47 and associated software can also capture isolated elements of a golfer's swing, image capture beginning and concluding at predetermined swing points as per user's loaded preferences in associated software.

Image capture component 47 can image capture from a frontal/face-on orientation with the golfer and/or can also capture from a side-view of the golfer. Additionally, both and/or all image capture components can image capture different views in concert, thus, for example, image capturing a frontal/face-on video of a golfer's swing as well as the golf ball flight pattern from the side-view image capture component. In the case of a frontal/face-on image capture the image capture component 47 capturing frontal/face-on golfer swing image(s) would be located on one side of data receiving component 40 (and may be mounted to a traditional golf bag cart and/or a traditional or pull cart. In the case of a side-view image capture the image capture component 47 capturing side-view golfer swing image(s) would be located on the front of data receiving component 40. Additionally, both and/or all image capture components 47 can image capture in concert, thus, for example, image capturing a frontal/face-on video of a golfer's swing as well as the golf ball flight pattern from the side-view image capture component.

Swing data captured by device 10 is synced with each golf swing captured by image capture component 47 so that when viewing film captured by image capture component 47 data and information unique to that particular image capture is embedded and visible upon viewing of said film in a "hyperlink view".

For example, FIG. 14 is a screen shot of an exemplary "hyperlink view" (right). If a golfer and/or golf instructor is viewing video of said golfer's 2nd swing of hole number 2 at Willow Bay County Club and the golfer is using the 7 iron then the film can be synced with data indicating "Willow Bay CC, Hole #2, Shot #2, 7 Iron, distance to pin 87 yards, shot distance 84 yards . . . " and any other information, either by default setup of software or personalized setup, deemed relevant to film evaluation such as, but not limited to, acceleration, velocity, swing arc, golf ball travel path, etc.

In the event of a golf ball's landing position being obstructed from image capture component 47 such as, but not limited to, a water hazard, sand trap, tree and/or other interfering object and/or body the particular swing associated with this position can register "image capture capabilities unavailable" in the sequence of golfer's archived film. These obstructions are recognized by way of algorithms linking golf ball flight data captured by the device 10 and data receiving device 40 capabilities through an array of functions such as but not limited to location identifying component 42 and/or preloaded course specific cartography and registered course features with corresponding GPS markers.

The above described embodiments of the electronic device 10 and the data receiving device 40 can be used by the golfer and/or someone, such as but not limited to, a golf instructor, accompanying a golfer to sense, analyze, evaluate, instruct, etc. a golfer's swing characteristics, interpret golf ball flight data as captured and computed by device 10 and data receiving device 40, and/or recognize and apply course playability data to the round of play. These and other features and functions of device 10 and data receiving device 40 as they pertain to the golfer, the field of competitive golf, the golf course/country club, golf iron and equipment manufacturer(s), golf apparel/merchandise manufacturer(s) and retailer(s), and general advertiser(s) are described in more detail below. The aforementioned categories as they relate to and interact with device 10, data receiving device 40, and associated software should be understood as exemplary categories for the purpose of advancing invention understanding by one skilled in the art and are not to be taken in as limiting factors.

Figure 6:
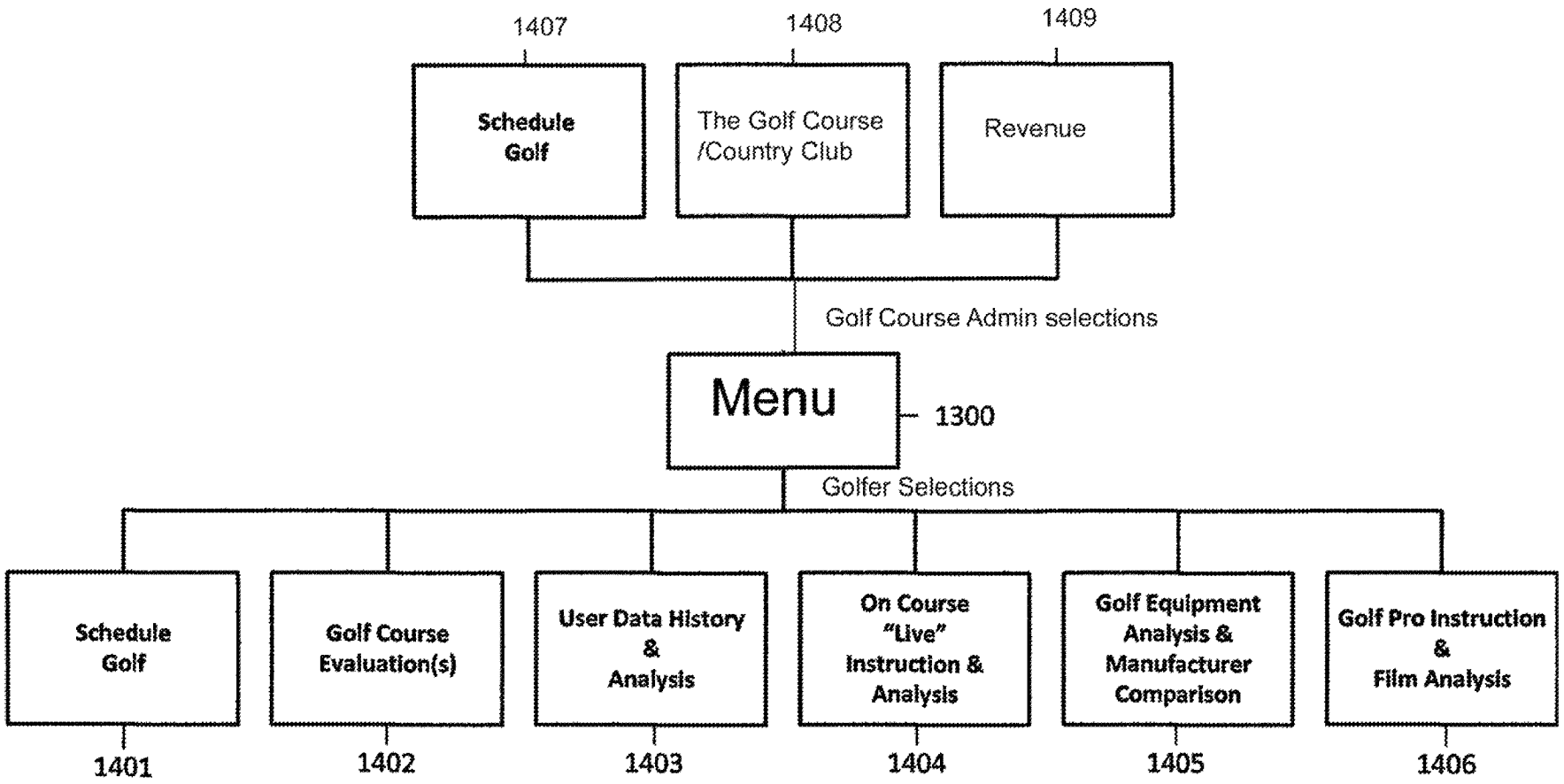
FIG. 6 is a block diagram illustrating software functional organization of device 40 of FIG. 1.

FIG. 6 is exemplary block diagram of the data receiving device 40 software. The software initiates to a menu 1300 and branches to functional modules including, but not limited to, schedule golf 1401, golf course evaluation(s) 1402, user data history and analysis 1403, on course "live" instruction and analysis 1404, golf equipment analysis and manufacturer comparison 1405, and/or golf pro instruction and film analysis 1406.

Figure 7:
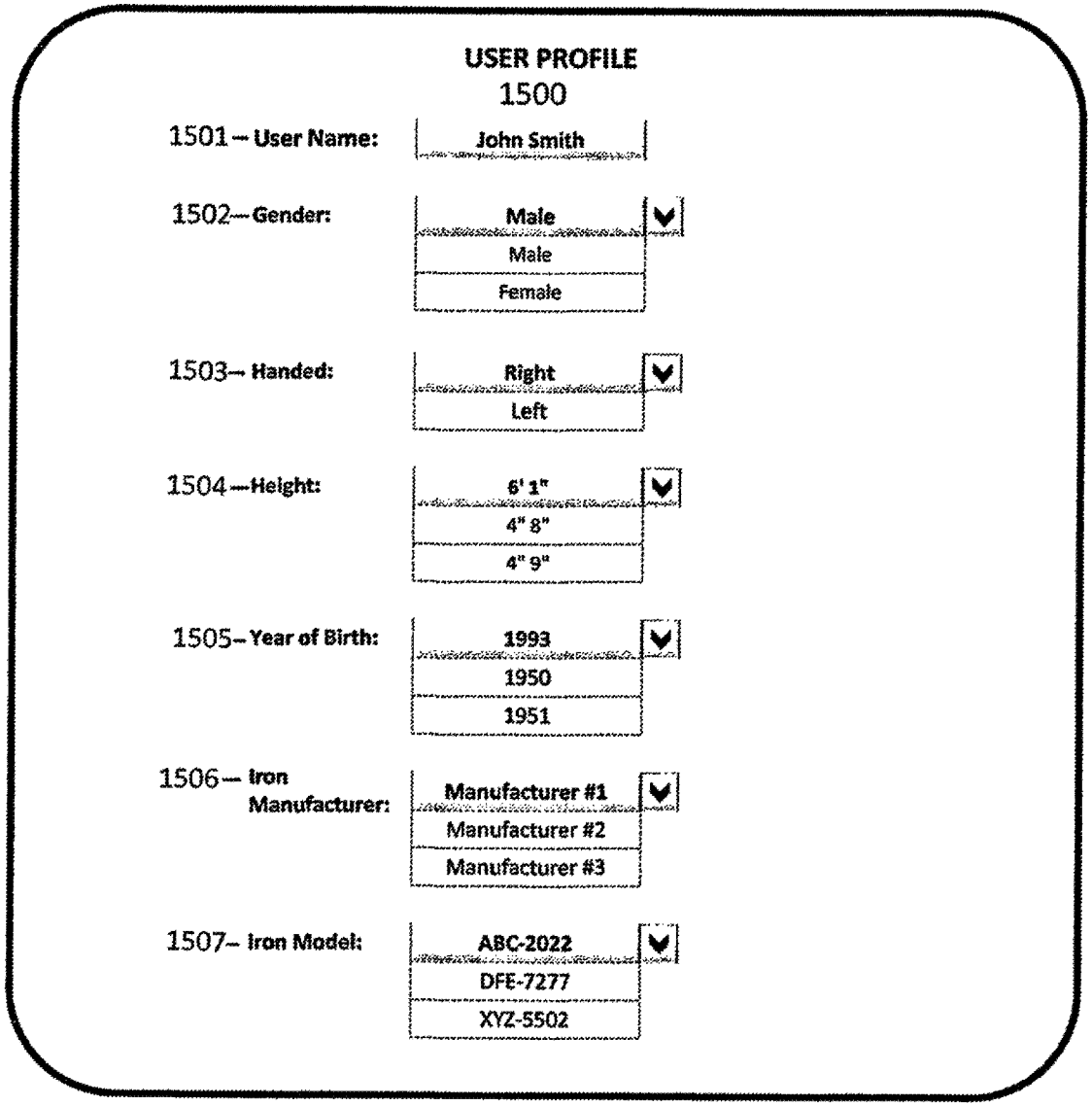
FIG. 7 is exemplary of a screen display of a User Profile page associated with software related to device of FIG. 1, inclusive of supplemental user information and standard default information of User Profile.
Figure 7:
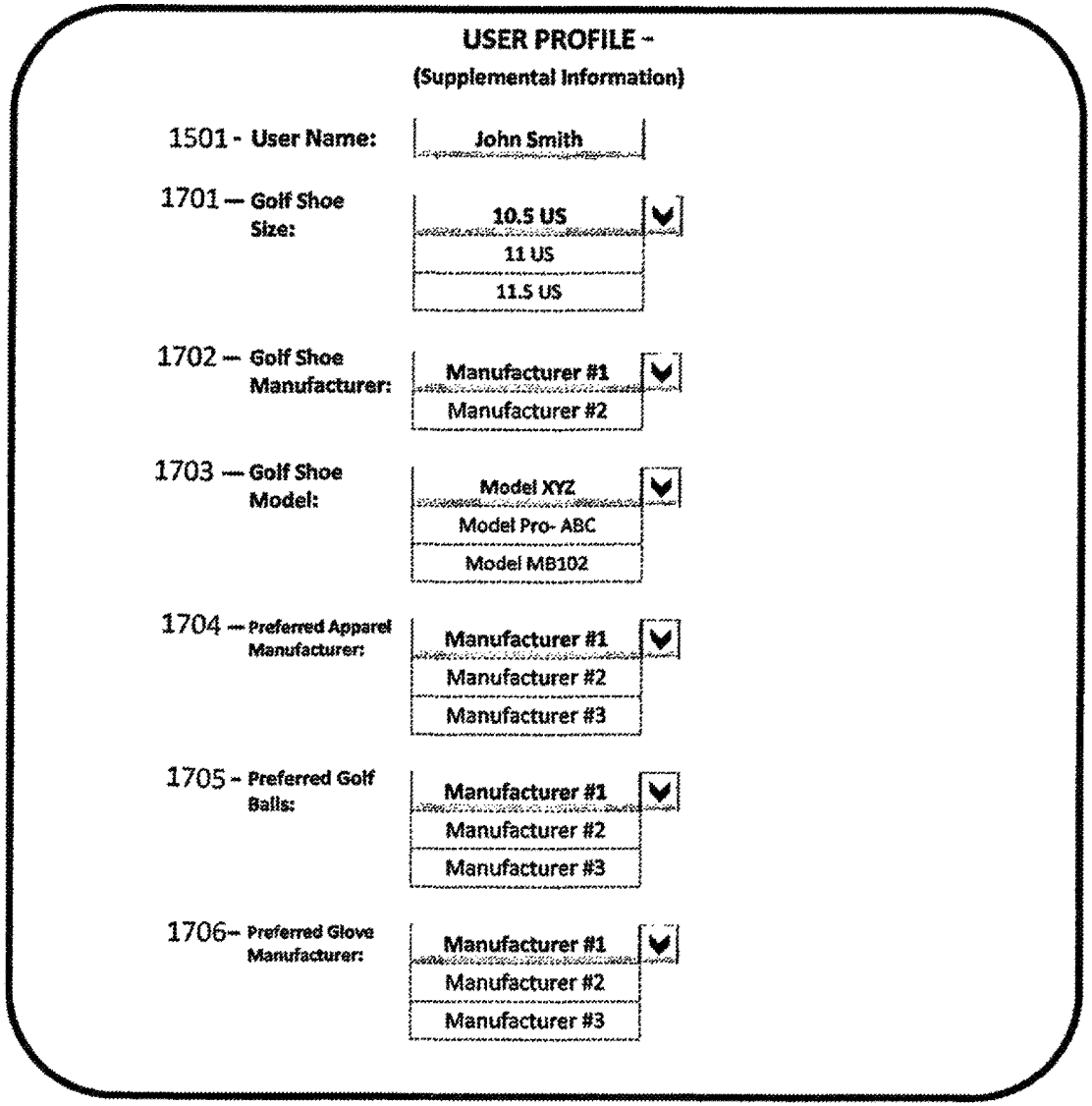

The user data history and analysis 1403 requires pre-entry of a golfer's user profile. FIG. 7 illustrates an example of a golfer's user profile 1500. Categories of the user profile 1500 Include: User Name 1501, Gender 1502, Handed 1503, Height 1504, Year of Birth 1505, Iron Manufacturer 1506, and Iron Model 1507; all exemplary of default categories that can be associated with a user profile 1500. These categories can be manually entered by the golfer in creating a user profile 1500 and/or fields can be automatically populated via bar code scanning, SKU# entering, and/or other data downloading capabilities.

A standard default exemplary scenario for user profile 1500 automated setup would be as follows; a golfer orders a new set of irons, the iron manufacturer establishes a bar code coded with golfer specific data associated with ordered irons, the golf irons are delivered to the customer, the customer removes delivered new golf irons from the box, the golfer downloads the App associated with device 10 and related software to his smart watch, personal computer, and/or smart phone, the App downloads, the initial setup screen of App offers the option of scanning a bar code, SKU #, and/or other data downloading capabilities, the golfer scans the bar code associated with the new golf irons with his smart phone (e.g., data receiving device 40) and the data associated with the new golf iron order is automatically populated in the user profile 1500 and device 10 is now setup and ready for use. FIG. 7 also shows supplemental information that can also be associated with device 10 and associated software beyond the scope of default user profile settings. Aspects of the supplemental information page can also be entered either manually or automatically as described in the above user profile 1500 automated setup description. For example, in this exemplary scenario a golfer orders a new pair of golf shoes. The golf shoes arrive from golf shoe manufacturer #1 and are accompanied with a bar code tag. The bar code tag is coded with product information such as but not limited to golf shoe size, golf shoe manufacturer, and golf shoe model. The golfer scans said bar code and related data is automatically populated into the user profile 1500.

Figure 8:
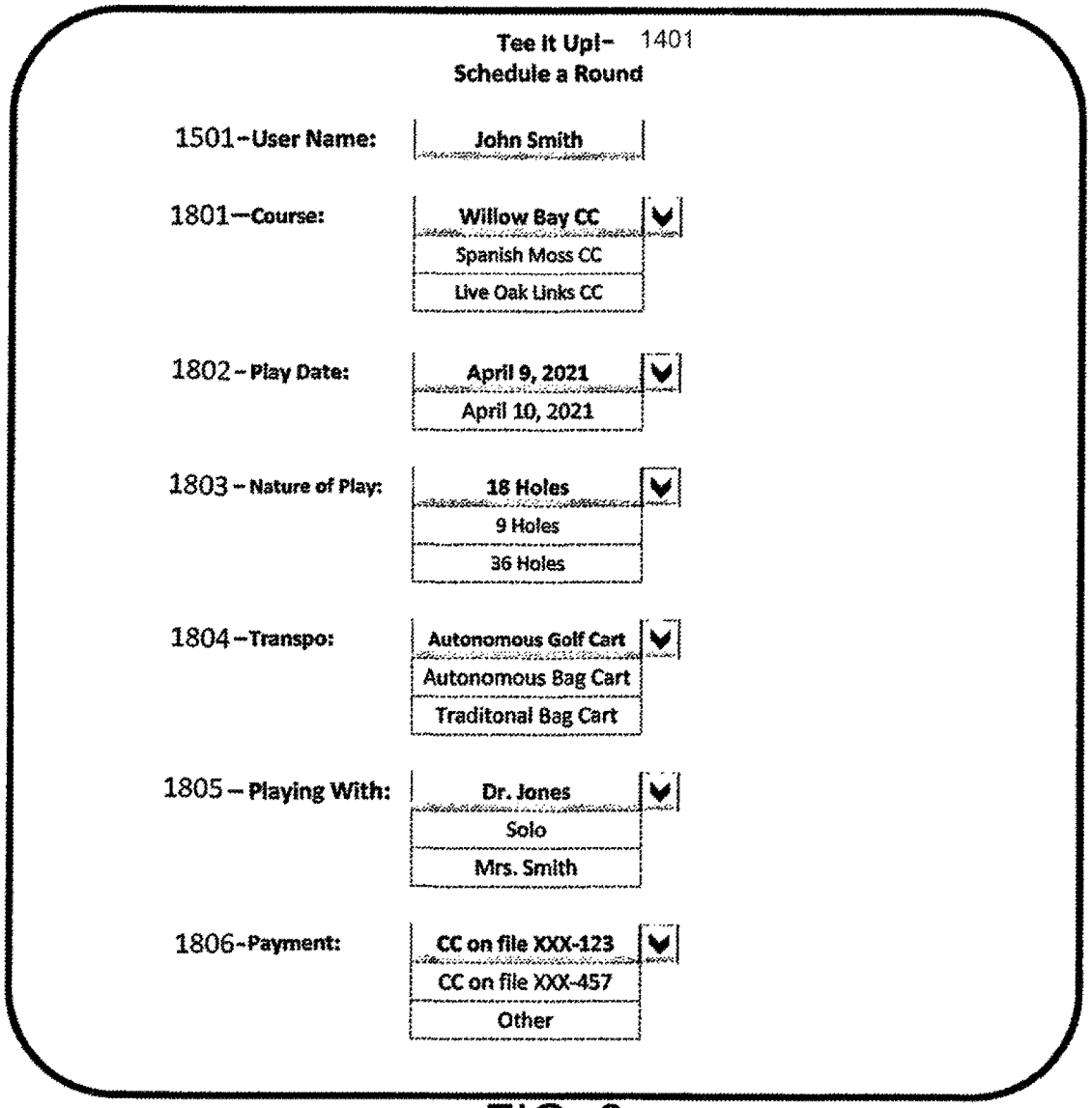
FIG. 8 is exemplary of a screen display of the Schedule Golf selection 1401 of FIG. 6.

Referring back to FIG. 6, one exemplary feature enabled by related software associated with device 10 and data receiving device 40 which is applicable to the software is that of the capability to schedule a round of golf at 1401 through the App associated with a user profile 1500. FIG. 8 illustrates such an exemplary "Tee It Up!" page 1401. The golfer selects the following exemplary criteria; Course 1801, Play Date 1802, Nature of Play 1803, Transpo 1804, Playing With 1805, and Payment 1806. In so doing, selected course criteria data pre-populates the Golf Course/Country Club evaluation 1402 illustrated in the block diagram FIG. 6 thus the round of golf specified being officially scheduled.

Referring back to FIG. 6, the golfer may choose "Live Instruction and Analysis 1404".

Figure 9:
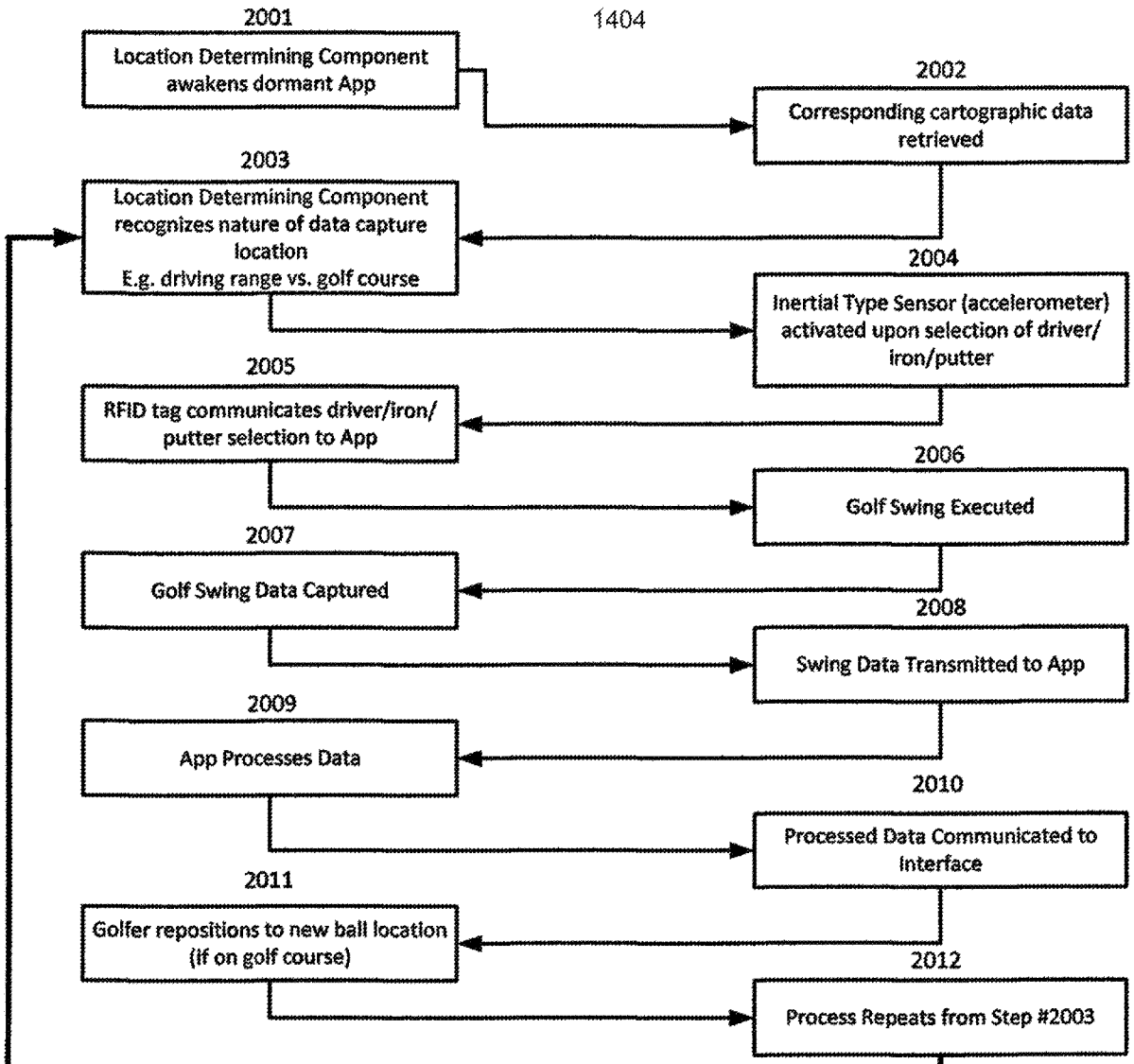
FIG. 9 is an exemplary flow diagram illustrating a sequence of events that can occur during Live Instruction and Analysis 1404 of FIG. 6.

FIG. 9 is a flow chart of the software steps using the device 10 for "Live Instruction and Analysis 1404" shown in FIG. 6. The particular order of steps illustrated in FIG. 9 and described herein can be altered without departing from the scope of the invention. At step 2001 at a triggering event (e.g., when a golfer is a predetermined default distance from the golf course) the location determining component 42 is activated from a dormant state. At step 2002 cartographic data corresponding to the golf course being played is retrieved and loaded into software associated with device 10. At step 2003 the data receiving device 40 analyzes location data to determine the nature of data capture, e,g, driving range versus actual course. At step 2004 when the golfer does in fact arrive at Hole #1 the inertial type sensor 31 tasked with identifying driver/iron/putter movement from grip down in-the-golf-bag orientation to grip up out-of-the-golf-bag orientation as described earlier. Step 2005 follows with the RFID tag or other identifying technology activating and transmitting to the data receiving device 40 which driver/iron/putter has been selected. The golfer then addresses the golf ball and the golf swing is executed 2006 and filmed by image capture component 47 with golf swing film capture procedures aforementioned. The golf swing data is captured 2007, data including but not limited to club head acceleration, golf shaft angular characteristics, golf swing arc points from golf ball address to back swing termination point to down swing conclusion and follow-through. The App processes golf swing data 2009 arriving at certain deductions such as but not limited to golf ball travel path, golf ball spin rate, golf ball acceleration/travel rate, and/or golf ball approximate landing location. Such interpreted golf swing data capture is presented on the display 44 of data receiving device 40, the golfer can access and apply such data, golfer repositions to new golf ball location 2011, and the process repeats from step 2003.

The Live Instruction and Analysis 1404 of FIGS. 6 and 9 also includes live course analysis that can occur in association with device 10 and data receiving device 40 from arriving at the tee box of a hole, in this example Hole #1, and concluding with the sinking of a putt on a green.

Figure 10:
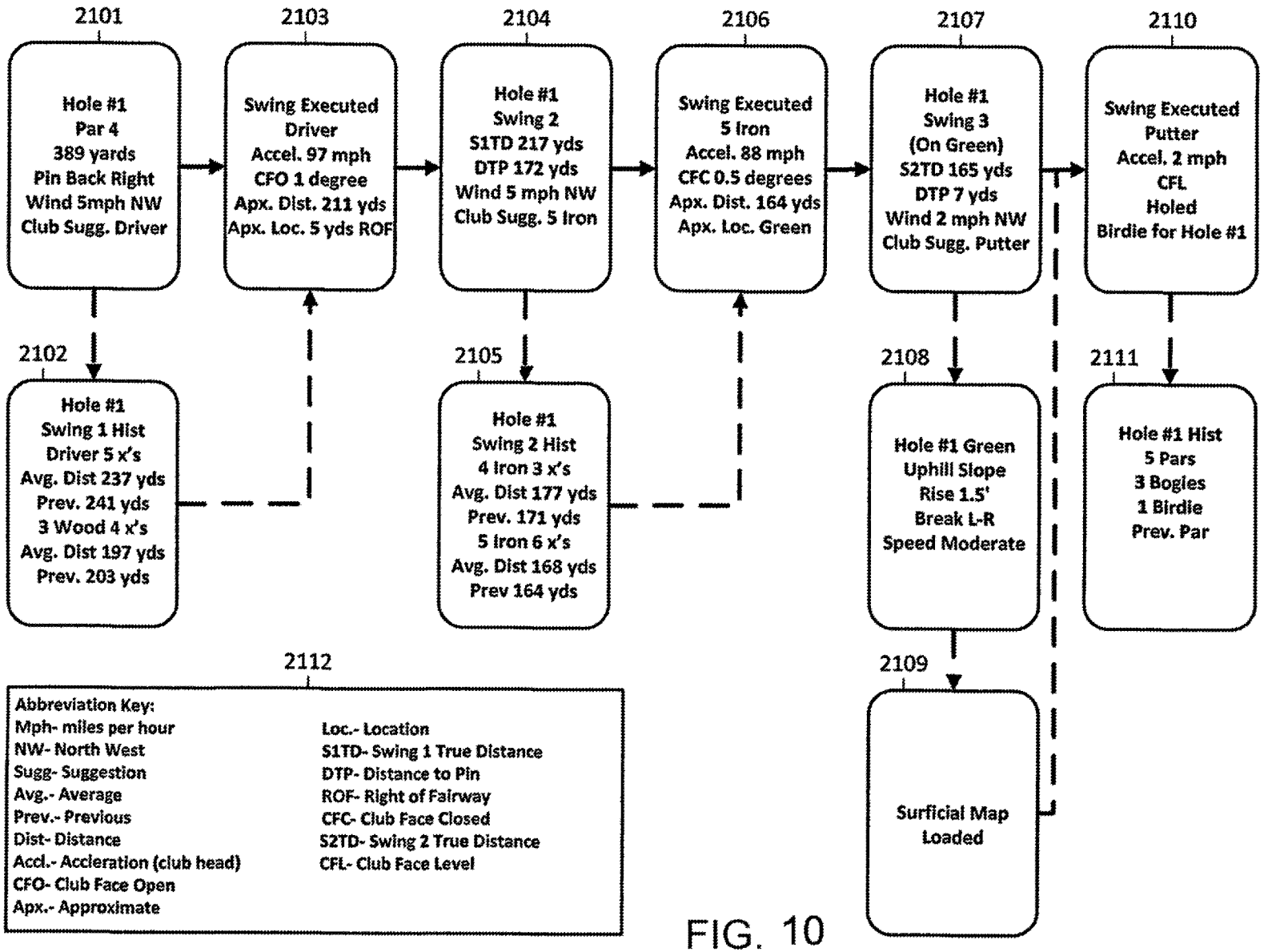
FIG. 10 is a block diagram illustrating an exemplary live course analysis.

FIG. 10 is a block diagram illustrating an exemplary live course analysis. As a golfer approaches a hole at step 2101, in this case Hole #1, the data receiving device 40 display 44 can display information such as hole number, par of hole, distance to the pin, pin location, wind speed, and/or club suggestion. The golfer can interact with display 44 accessing additional information such as that displayed in 2102. The information displayed in 2102 further advances the golfer's decision making process in hole approach and strategy via information such as but not limited to; his swing history at the particular hole including history such as previous driver/iron/putter used and distance golf ball struck with said driver/iron/putter. This additional information can be setup as a default natural and logical next step in the information display process to the golfer or it can be optional or personalized by the golfer per his preferences. Step 2103 data capture includes identifying of golf swing execution, golf swing acceleration, club face angular orientation, approximate distance of golf ball travel and approximate golf ball landing location data captured by the inertial type sensor 31 of device 10. The driver/iron/putter identification in this step 2103 is the product of the driver/iron/putter identifying component 30 of device 10. Information displayed in step 2104 indicates that the golfer is approaching swing #2 of Hole #1, that his S1TD or shot one true distance was 217 yards, that the DTP or distance to the pin is 172 yards, wind 5 mph out of the Northwest, and that the club suggestion for this second swing based upon golfer archived history is the 5 iron. It bears to note that the S1TD of 217 yards differs from the Apx. Dist. or approximate distance of 211 yards reported in step 2103. Apx. Dist. of step 2103 is approximated as a result of algorithms formulated based upon the golf swing data captured by inertial type sensors 31 of device 10. While relatively precise these calculations are limited in scope and ability to encompass all variables acting upon golf ball travel distance. Therefore, when a golfer repositions at the actual golf ball landing location, of shot #1 in this example, then the location determining component 32 identifies actual golf ball landing coordinates, the result being the establishment of S1TD or shot one true distance data of 217 yards in this exemplary illustration. As per illustration 2102, illustration 2105 bears the same description as that of being additional default, optional, and/or personalized information available in advancing a golfer's decision-making process in hole approach and strategy. Display 2106 also bears the same description as that of display 2103 but in the context of data related to swing #2 rather than that of swing #1 found in 2103. Display 2107 bears the same description as that of display 2104 but in the context of data relevant to executed swing #3 and anticipated swing #4. 2108 display is in accordance with descriptions relevant to 2101, 2102, and 2105. It should be noted that through the course of the above mentioned displays data presented to the golfer can be in the form of text, audible transmission, graphic presentations and/or any other manner of conveying information utilized in further advancing a golfer's decision making process in hole approach and strategy. With that in mind, display 2109 offers a surficial map of the putting green of Hole #1 in this exemplary case.

Referring back to FIG. 10 display 2110 bears the same description as that of display 2103 and 2106 but in the context of data related to swing #3, in this exemplary scenario that swing #3 being of the putt variety. Display 2111 summarizes the particular golfer's history of the hole, in this case Hole #1, thus advancing the golfer's understanding of current hole performance in relation to previous performances per the same hole. 2112 is an "Abbreviation Key" used in the interpretation of data present in displays 2101 through 2111 of FIG. 10.

Figure 11:
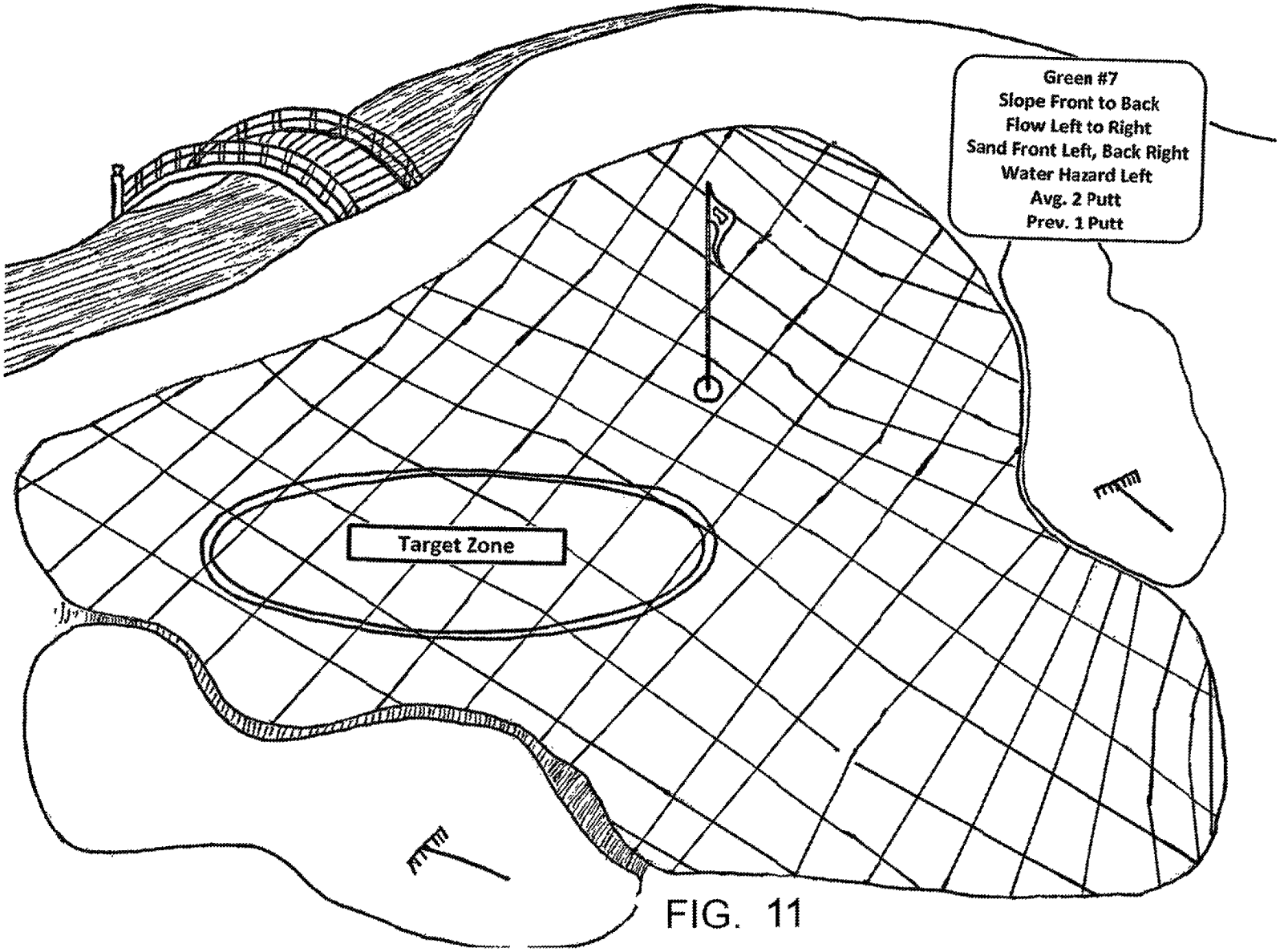
FIG. 11 is an isometric view of a screen display of data receiving device(s) of FIGS. 1-3 of cartographic map/rendering of a golf green approach with corresponding user shot data.

FIG. 11 is an example of a surficial map display 2109 which graphically illustrates the qualities, characteristics, and data associated with a golf green, in this case green #7. Similar graphic illustrations can also include but be not limited to tee box view graphics, hole layout graphics, sand trap and/or water hazard graphics, golf course encompassing layout graphics, and/or any other illustrative graphics deemed relevant to the scope of the present invention. FIG. 11 illustrates the layout of green #7 and the surrounding physical features that can come into play concerning green #7. Pin location, sand bunker location, water hazard location, green slope and flow grid, and golf ball landing target zone is identified by way of this graphic for illustrative purposes. Additionally, FIG. 11 is illustrative of exemplary data display combination of both graphic display information and text display information working in concert through the text box information contained and displayed within.

The Live Instruction and Analysis 1404 of FIGS. 6 and 9 may also include team analysis of aggregated data from multiple individual golfers. For example, the division, High School, College and University Teams can benefit from greater team oriented data analysis and evaluations. Exemplary functions pertaining to team evaluation can include but are not limited to data analysis per each graduating year category, such as isolating and evaluating golf swing data of the freshman class team members. In this exemplary scenario reports can be generated tracking data progress, or regression for that matter, of an entire graduating class as it progresses from freshman year to sophomore year to junior year to senior year.

The Live Instruction and Analysis 1404 of FIGS. 6 and 9 can also include "pairing" analysis. Often in team related golf competition individual team members are "paired" as they compete against other "paired" team members of a competing school. Software associated with device 10 and data receiving device 40 that addresses "pairing" evaluation and analysis would therefore further advance understanding and foster competitive edge in the science of establishing the most effective and productive "pairing" groups per team per competitor by a team coach.

For example, teammate #1 and teammate #5 may have been paired together for the first 25% of the competitive golf season. For the middle portion of the competitive golf season teammate #1 may have been paired with teammate #3, and teammate #5 paired with teammate #2. The team may be in 3rd place of their division and looking for an edge entering conference playoffs. A coach in this scenario can access archived data associated with pairings for the season, resulting from device 10 and data receiving device 40, and discover that against Team A pairing teammate #1 with teammate #2 would be most effective and against Team B that pairing teammate #1 with teammate #5, as in the first 25% of the competitive golf season, would be the most effective.

Device 10 and data receiving device 40 software capabilities can also address course specific decisions and strategies of a golfer as they pertain to competition against other specific golfers. For example, professional golfer #1 is playing in a 3 day tournament. It is the evening of the second day of competition and the final round of play is the following day. Professional golfer #1 finds himself 4 strokes behind the leader, professional golfer #7. Professional golfer #1 is meeting with his coach the evening of the second day of competition and they are mapping out strategy and scenarios for the final round of play. In analyzing approach of play for the final round the coach and professional golfer #1 access opponent related data via software associated with device 10 and data receiving device 40. As a result, in some exemplary functions of the software, the coach and professional golfer #1 can statistically determine tendencies of professional golfer #7, such as but not limited to, which holes professional golfer #7 can be vulnerable on for professional golfer #1 to take a calculated risk and attempt to gain a stroke on the 4 stroke lead. Conversely, data can also indicate holes and/or specific swing #'s on specific holes when to play it traditional and safe therefore limiting the possibility of losing a stroke and turning the 4 stroke lead into a 5 stroke lead. The access of hard data related to both the competitor and the competition can afford a definitive competitive edge in approach and strategy rooted in verifiable scientific hard data as opposed to approach and strategy sourced from hunch, speculation, and/or opinion.

The software associated with device 10 and data receiving device 40 can be uniquely applied to other aggregations of data defining other divisions such as High School, College and University Teams, Amateur competition, and/or Professional competition without falling outside of the scope of the present invention.

Figure 12:
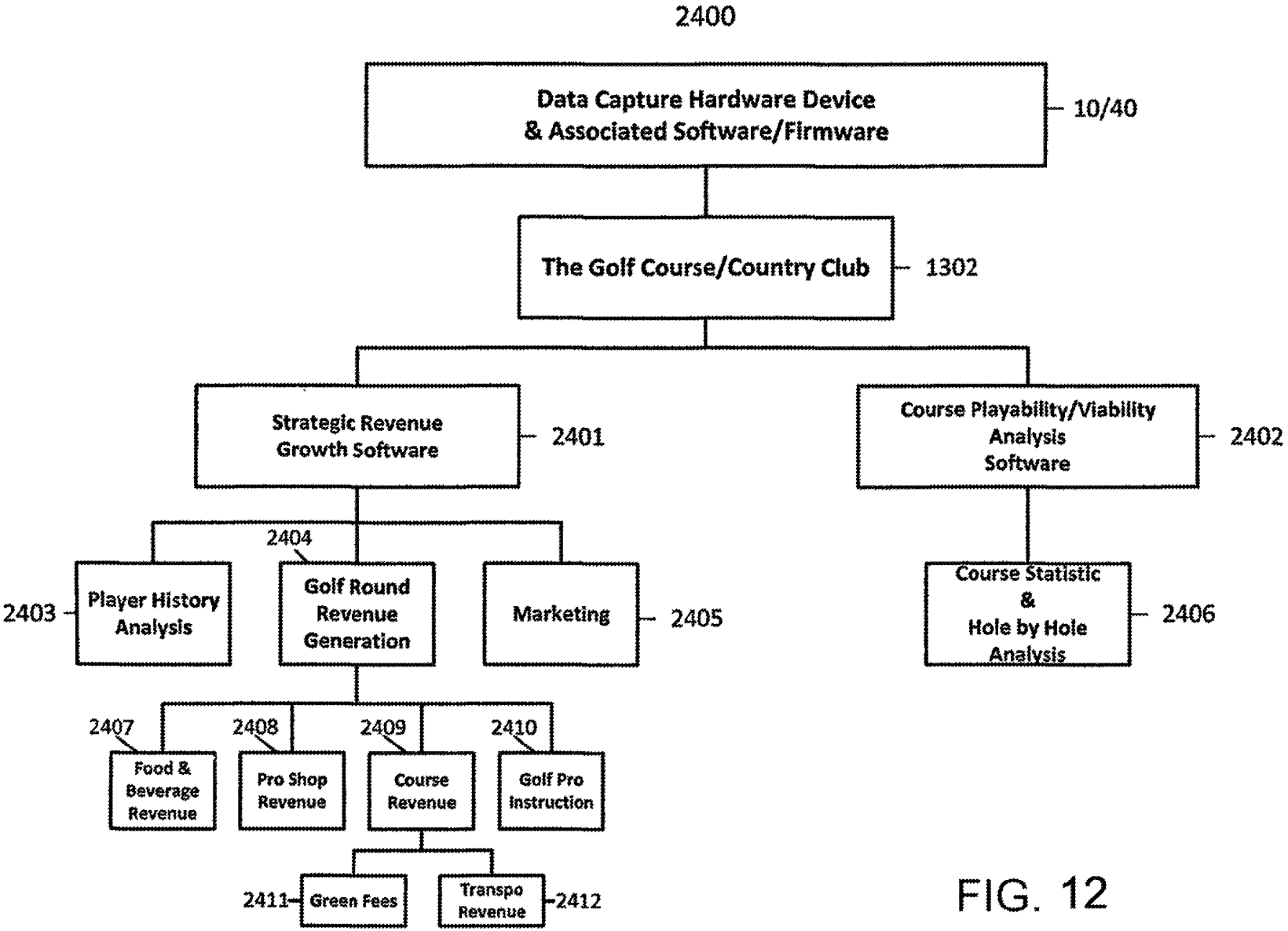
FIG. 12 is a block diagram illustrating fields of data application as captured by device 10 of FIG. 1 and processed/applied by data receiving device 40 of FIG. 4 for the selection of The Golf Course/Country Club 1408 as found in FIG. 6.

FIG. 12 is a block diagram illustrating fields of data application as captured by device 10 of FIG. 1 and processed/applied by data receiving device 40 of FIG. 4 for the selection of The Golf Course/Country Club 1408 as found in FIG. 6. Under the sub-category of The Golf Course/Country Club 1408 exemplary areas of device 10 and data receiving device 40 application can be, but are not limited to, strategic revenue growth and/or course playability/viability analysis. Some exemplary areas that can fall under the umbrella of strategic revenue growth software for a golf course/country club 1408 can include but is not limited to; player history analysis, golf round revenue generation, and/or strategic marketing of a golf course/country club.

Referring back to FIG. 6, scheduling software 1407 associated with device 10 and data receiving device 40 can be capable of establishing a start time and end time for a round of golf. Therefore, a golfer's average playing time per specified golf course/country club can be assessed. For example, if golfer #1 has accessed "Tee It Up!" 1800 feature and is scheduling an 18 hole round of golf at Spanish Moss Country Club golfer archived history can indicate the pace of play for that particular golfer for that particular course. Algorithms linking particular golfer pace of play with a golf course/country club's current roster of scheduled players for a given day can automatically "blackout" certain time slots, though those time slots are technically available in the day, against a particular golfer given that golfer's average time per round of golf, and thus minimizing negative effects that long average time of play can have on golf round revenue generation. Conversely, the same scenario can "blackout" certain time slots and funnel a golfer with more friendly and efficient average time of round play into certain desirable time slots, therefore too, advancing the objective of strategic revenue growth software.

FIG. 13 illustrates two manners of accessing data using The Golf Course/Country Club 1408 selection as found in FIG. 6, including a spreadsheet view 2601 and a hover view 2602. These two manners are exemplary and should not be considered in a limiting fashion.

Spreadsheet view 2601 illustrates a hole by hole synopsis in "real time" as to how each hole is progressing in terms of "standard play time." For example, 2603, Hole #3 has 4 golfers playing it, the standard play time for the hole is 5 minutes, the current play time for the hole is 7 minutes, the 4-some is plus 2 minutes over standard play time, a Marshall visit has occurred, and golf cart rate of speed has been increased 1 mph.

Hover view 2602 conveys similar, if not the same, data as spreadsheet view 2601 but in a hover view where a golf course administrator and/or other person tasked with access, can scroll-over or "hover" over a hole on the golf course layout map and hole data is presented in a dialog box.

Referring back to FIG. 6, the golfer may choose "Golf pro Instruction and Film Analysis 1406." FIG. 14 is an exemplary illustration pertaining to golfer swing data that can be isolated, analyzed, and evaluated as a result of golfer swing data capture via device 10 and processed/applied by data receiving device 40. For exemplary purposes FIG. 14 deals with said captured golfer swing data as related to instructional purpose, however, captured golfer swing data as displayed in spreadsheet view 2901 and hyperlink film view 2902 should not be considered limited in scope as to instructional purposes only and can apply to a wide range of purposes pursued by a user of said capture data. In FIG. 14 a user has isolated and populated golfer swing data as it pertains to the 7 Iron for the dates Jan. 1, 2021 through Feb. 28, 2021, 2903. Golfer swing data captured for said time frame and said golf iron indicates that the golfer has played the golf courses of Willow Bay, The Oaks, and Spanish Moss during the selected time frame. The spreadsheet communicates captured data as broken down in the following categories; Course, Date, Hole #, Par of Hole, Shot #on hole, Ball Location, Distance to the Pin, Shot Distance, Acceleration, Spin, Club Face on Impact, and Impact Rating. Such categories can represent default settings of software associated with device 10 and data receiving device 40 and/or can represent personalized categories and settings established by the user. FIG. 14 also illustrates the relationship that can exist between captured golf swing data and the filmed golf swing. For instance, 2904 is hyperlinked affording a user the ability to click on hyperlink "Willow Bay" of 2904 resulting in the associated filmed golf swing 2902 to populate with corresponding golf swing data found in spreadsheet 2901 to be found also embedded in film as seen below golfer of 2902.

Figure 15:
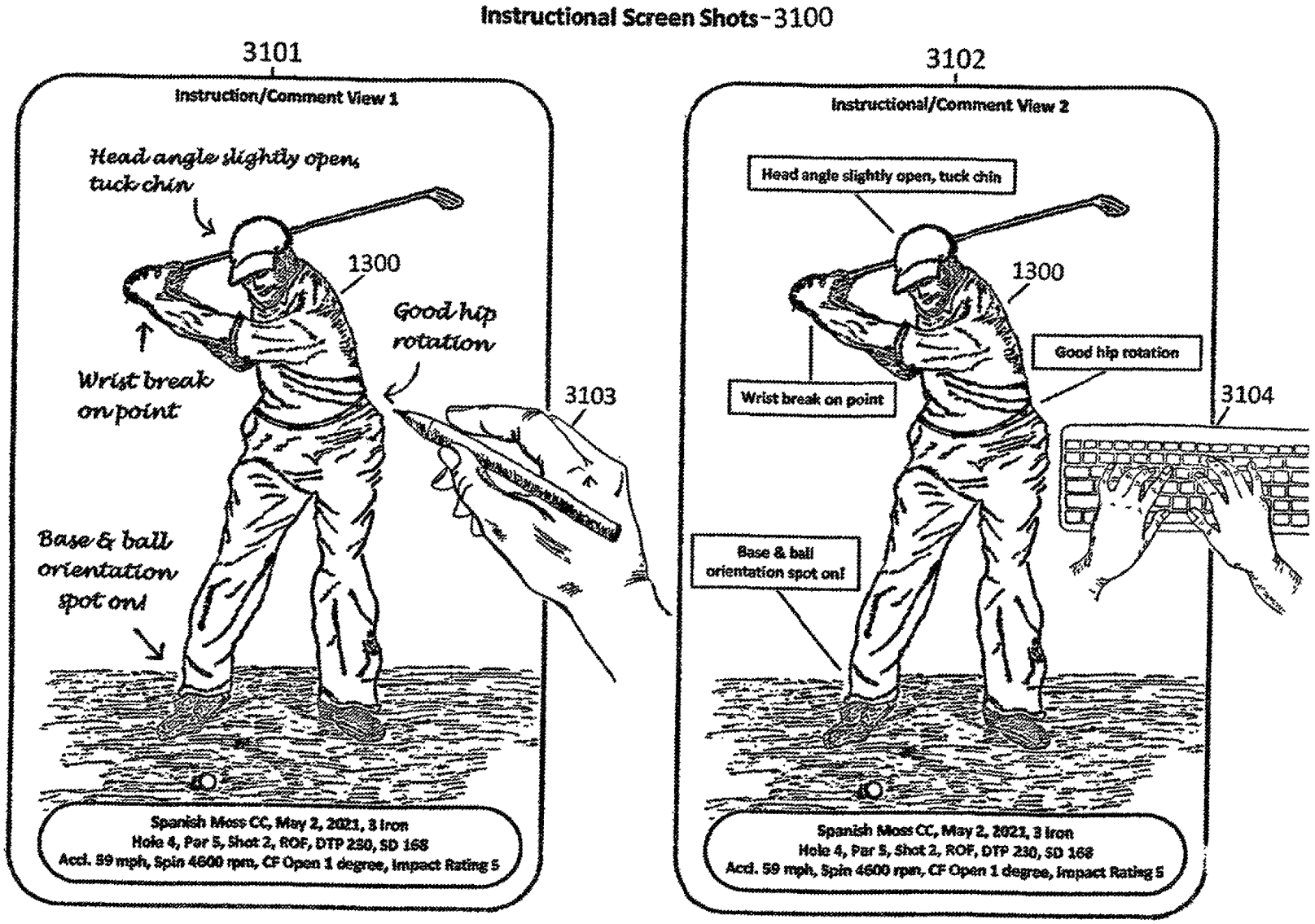
FIG. 15 illustrates two manners of embedding diagnostic instructional "coaching points".

One function associated with device 10 and data receiving device 40 software, as mentioned prior in describing image capture component 47, is that of the ability of the invention to film a golfer's golf swing and embed golf swing data captured with said correlating filmed golf swing. For example, instructional notes can be captured, embedded, and displayed in spreadsheet view 2901 and/or hyperlink film view 2902. For example, FIG. 15 illustrates two manners of embedding diagnostic instructional "coaching points" in 3101 and 3102. Both 3101 and 3102 can perform the same functions but with one, 3101, embedding instructional information on film through the means of a stylus and the user physically writing 3103 said instructional information on the display, and/or, method 3102 where embedded instructional information on film is done through the means of a keyboard or similar typing device 3104. Other means of embedding instructional diagnostic "coaching points" in similar manners do not fall outside of the scope of the present invention. Embedding preserves instruction for later viewing.

Referring back to FIG. 8, the golfer may choose "Golf Course Evaluation(s) 1402."

FIG. 16 is exemplary of software associated with the sub-category The Golf Course/Country Club 1302 and pertains to Course Playability/Viability Analysis software 2402. Illustrated in this example are two manners of accessing Course Playability data, a spreadsheet view 3201 and a hover view 3202, identical course playability data is accessible in either manner. Additionally, the manners of data representation of FIG. 16 are for illustrative purposes and other manners of representation do not fall outside of the scope of the present invention.

Spreadsheet View 3201 is representative of data associated with a golf course's playability. Given that device 10 and data receiving device 40 capture, track and interpret golfer swing data it stands to reason that said data can materialize in a definitive understanding of how a golf course and the physical features within function with regard to true playability. A deeper understanding of playability of a golf course lends itself to an array of uses. One of which can be, but is not limited to, the ability to determine worthwhile and/or useless features of a golf course. In examining the statistical data associated with golf course features a golf course administration, in this case, can intelligently eliminate and/or add features to make a golf course more or less playable.

For instance, in spreadsheet view 3201 column 3203 data captured indicates that for Hole #1, 5% of golfers tee off from the White Tee, 85% from the Yellow Tee, 10% from the Red Tee. That the 1st Sand Trap only captures 1% of golfer golf balls, Sand Trap #2 captures 5%. That the 1st Water Hazard captures 4% of golfer golf balls, that 12% of golfers strike the ball Out of Bounds Right, 3% Out of Bounds Left, and 1% Out of Bounds Beyond. It further indicates that the average distance of the 1st shot is 175 yards, the 2nd shot 120 yards and the 3rd shot 42 yards, with average putts being 2, the average hole score 5 and the hole rating 7.

Given such course playability data, a golf course/country club administrator, a golf course architect, and/or any other entity concerned with course playability data can, in this exemplary illustration, determine that the 1st Sand Trap of Hole #1 which captures only 1% of golfer golf balls is useless and that upon redesign of the golf course that said sand trap will be removed and replaced with a more applicable feature. Thus golf course playability data lending itself to greater golf course/country club playability and theoretically translating into greater golf course/country club revenue generation.

Although the invention has been described with reference to the preferred embodiment illustrated in the attached drawing figures, it is noted that equivalents may be employed and substitutions made herein without departing from the scope of the invention.

Having now fully set forth the preferred embodiment and certain modifications of the concept underlying the present invention, various other embodiments as well as certain variations and modifications of the embodiments shown and described will obviously occur to those skilled in the art upon becoming familiar with the concept. It is to be understood, therefore, that the invention may be practiced other than as specifically set forth herein.

I claim:

1. A system for golf swing analysis, comprising:

a data collection device, including, a housing configured to be affixed internally within the shaft of a golf club;

a first circuit contained within said housing and including, at least one inertial sensor configured to capture an orientation change when said golf club is selected for use, and X, Y, and Z axial acceleration data during swinging of said golf club, a geolocation sensor for providing geolocation data determining a location of said golf club, a golf club identification tag for providing club identification data, and a data transmitter for wireless communication of said swing data;

a data receiving device in wireless communication with the data transmitter; and a golf swing analyzer in communication with said data receiving device, said golf swing analyzer comprising a processor and a computer-readable memory storing computer-executable instructions for analyzing a combination of golf course data, said geolocation data, said club identification data, and said X, Y, and Z axial acceleration data and calculating club selection when said golf club is selected for use, geolocation, and a golf swing characteristic therefrom and displaying user shot data relative to a cartographic rendering of said golf course.

2. The system for golf swing analysis according to claim 1, wherein said golf course data is stored on said memory.

3. The system for golf swing analysis according to claim 1, wherein said golf swing analyzer uses golfer specific profile data in said analysis.

4. The system for golf swing analysis according to claim 3, wherein said golfer-specific profile data includes individualized historical shot data including average distance and accuracy for different clubs and holes.

5. The system for golf swing analysis according to claim 1, wherein said at least one inertial sensor comprises any one or more of an accelerometer, gyroscope, or magnetometer.

6. The system for golf swing analysis according to claim 1, wherein said at least one inertial sensor captures golf swing data at all points of an executed golf swing.

7. A system for golf analysis, comprising:

a data collection device inserted and affixed to the interior shaft of a golf club and including, a first processor, a club-identification tag, an inertial sensor, a location sensor, and a housing; and a data receiving device in wireless communication with said data collection device, and including, a second processor, a display, a user interface, a location sensor, a housing, and non-transitory computer-readable storage device storing software comprising a series of computer-readable instructions for carrying out the steps of, polling said data collection device for data inclusive of geographic coordinates corresponding to a point along a golf course, golf course data at said point, and golf club selection at said point, analyzing historical swing data and said geographic coordinates, golf course data and golf club selection at said point along said golf course, golf club selection at said points relative to said golf course data, and calculating an estimate of golf ball flight, trajectory, roll and lie, displaying said estimate relative to a cartographic rendering of said golf course; and comparing said estimate to actual swing data.

8. The system for golf analysis according to claim 7, wherein said series of computer-readable instructions carry out the additional step of analyzing golfer specific profile data.

9. The system for golf analysis according to claim 7, wherein said series of computer-readable instructions carry out the additional step of computing golf course playability.

10. The system for golf analysis according to claim 7, wherein said inertial sensor comprises any one or more of an accelerometer, gyroscope, or magnetometer.

11. The system for golf analysis according to claim 7, wherein said inertial sensor captures golf swing data at all points of an executed golf swing.

12. A system for golf analysis, comprising:

a data collection device configured for axial insertion and internal fixation inside a hollow cylindrical top section of a golf club shaft of internal diameter d1, said data collection device including, a club-identification RFID tag, a geolocation sensor, at least one inertial sensor configured to capture X, Y, and Z axial acceleration swing data during swinging of said golf club shaft;

a data transmitter for wireless communication of said swing data;

a battery, and a cylindrical housing configured to fit inside the hollow cylindrical top section of said golf club shaft and for enclosing said at least one inertial sensor, said club-identification RFID tag, said geolocation sensor, said data transmitter and said battery, said housing having a length and a maximum width <d1, a data receiving device in wireless communication with the data collection device; and a golf swing analyzer in communication with said data receiving device, said golf swing analyzer comprising computer-executable instructions for analyzing a combination of golf course data, location, and said X, Y, and Z axial acceleration data and calculating club selection, club location, angular club face orientation, golf ball acceleration, and golf ball spin, and displaying user shot data relative to a cartographic rendering of said golf course.

13. The system for golf analysis according to claim 12, wherein said golf swing analyzer comprises computer-executable instructions perform the steps of, determining that said golf club has been selected for use based on orientation from said at least one inertial sensor, and identifying said golf club, when selected for use, from said club-identification RFID tag.

14. The system for golf analysis according to claim 13, wherein said cylindrical enclosure is configured to index insertion and positioning within the distal upper handle end of said golf club shaft.

15. The system for golf analysis according to claim 14, wherein said golf swing analyzer comprises a processor and a computer-readable memory storing computer-executable instructions for analyzing said X, Y, and Z axial acceleration swing data and calculating a golf swing characteristic therefrom.

* * * * *